US008545281B2

(12) United States Patent
Shimomura et al.

(10) Patent No.: US 8,545,281 B2
(45) Date of Patent: Oct. 1, 2013

(54) METHOD FOR MANUFACTURING ELECTROLUMINESCCENT DEVICE

(75) Inventors: Akihisa Shimomura, Kanagawa (JP); Kaoru Hatano, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

(21) Appl. No.: 13/445,113

(22) Filed: Apr. 12, 2012

(65) Prior Publication Data

US 2012/0264346 A1 Oct. 18, 2012

(30) Foreign Application Priority Data

Apr. 13, 2011 (JP) ..... 2011-089601

(51) Int. Cl.
*H01J 9/00* (2006.01)

(52) U.S. Cl.
USPC ..... 445/58; 445/25

(58) Field of Classification Search
USPC ..... 313/498–512, 582–587, 495–497; 445/58, 24–25
See application file for complete search history.

(56) References Cited

U.S. PATENT DOCUMENTS

| | | | | |
|---|---|---|---|---|
| 5,874,804 | A * | 2/1999 | Rogers | 313/512 |
| 6,646,284 | B2 | 11/2003 | Yamazaki et al. | |
| 6,803,246 | B2 | 10/2004 | Yamazaki et al. | |
| 6,998,776 | B2 | 2/2006 | Aitken et al. | |
| 7,407,423 | B2 | 8/2008 | Aitken et al. | |
| 7,602,121 | B2 | 10/2009 | Aitken et al. | |
| 7,701,136 | B2 | 4/2010 | Kwak | |
| 7,944,143 | B2 | 5/2011 | Choi et al. | |
| 8,063,560 | B2 | 11/2011 | Aitken et al. | |
| 2003/0107315 | A1 * | 6/2003 | Chen et al. | 313/512 |
| 2007/0176549 | A1 * | 8/2007 | Park | 313/512 |

FOREIGN PATENT DOCUMENTS

| | | |
|---|---|---|
| JP | 2002-246183 | 8/2002 |
| JP | 2006-524419 | 10/2006 |

* cited by examiner

*Primary Examiner* — Anne Hines
(74) *Attorney, Agent, or Firm* — Husch Blackwell LLP

(57) ABSTRACT

To provide an electroluminescent device in which an element substrate provided with a light-emitting element and a sealing substrate are bonded to each other without causing thermal damage to the light-emitting element and which is formed using an electroluminescent material. A sheet 108 in which layers of at least two different kinds of metals are stacked is formed in a peripheral portion of one or both of the element substrate 102 provided with an EL element 104 and a sealing substrate 106 bonded to the element substrate 102 so as to face each other. Further, the sheet is irradiated with a focused beam, and the irradiation portion of the sheet is heated, whereby at least two kinds of metals are alloyed, and the element substrate and the sealing substrate are bonded to each other by heat generated in the alloying.

13 Claims, 13 Drawing Sheets

METHOD FOR MANUFACTURING ELECTROLUMINESCCENT DEVICE

BACKGROUND OF THE INVENTION

1. Field of the Invention

The present invention relates to an electroluminescent device using an electroluminescent light source.

2. Description of the Related Art

A display device or a lighting device using an organic electroluminescent material has problems such as decrease in the emission luminance, increase in the emission start voltage, and appearance of dark spots (non light-emitting portions) and increase in the area of the dark spots, which are caused by moisture included in the air. In order to solve such problems, a region where an element is fanned using an electroluminescent material is covered with a sealing substrate, and the sealing substrate is fixed with a sealant using an organic resin material (for example, see Patent Document 1).

Further, as a sealing structure of an electroluminescent device, a technique in which a sealing substrate and a substrate over which an element formed using an electroluminescent material is provided are bonded with a frit glass paste having a low melting point is disclosed (for example, see Patent Document 2). In this sealing technique, after a seal pattern using a glass paste is formed in a peripheral portion of an element substrate or a sealing substrate, the element substrate and the sealing substrate are superposed on each other, and the seal pattern is irradiated with laser light to be welded and cured, whereby both the substrates are bonded to each other.

REFERENCE

Patent Document

[Patent Document 1] Japanese Published Patent Application No. 2002-246183

[Patent Document 2] Japanese Translation of PCT International Application No. 2006-524419

However, a sealant formed using an organic material has a problem in that it has a relatively high permeability of moisture (water vapor) and moisture (water vapor) in the air penetrates into a sealed electroluminescent panel. Accordingly, as compared to the case of an electroluminescent panel without a sealing substrate, deterioration of an electroluminescent element can be suppressed in the case of an electroluminescent panel with a sealing substrate; however, there is a problem in that deterioration due to moisture (water vapor) cannot be suppressed sufficiently in the long term.

Further, a sealant formed using an inorganic material such as a glass paste has an advantage of a lower permeability of moisture (water vapor) than that of an organic resin material, whereas there is a problem in that a panel itself needs to be heated at high temperature in order that the sealant is fused and a light-emitting element is deteriorated due to the heat.

In the invention disclosed in Patent Document 2, a frit glass is used for sealing an electroluminescent panel, and it is necessary to add an additive for absorbing laser light in order to heat the frit glass by laser light. In a frit glass into which an additive is added, the property of the frit glass, such as a softening point of a glass, is changed, which is not preferable. Further, in order to fuse the element substrate and the sealing substrate to each other with a seal pattern formed using a frit glass, the entire seal pattern needs to be heated selectively, which causes a problem such as poor productivity.

In view of the foregoing problems, it is an object of one embodiment of the present invention to provide an electroluminescent device in which an element substrate provided with a light-emitting element and a sealing substrate are bonded to each other without causing thermal damage to the light-emitting element and which is formed using an electroluminescent material.

SUMMARY OF THE INVENTION

According to one embodiment of the present invention, a sheet in which at least two kinds of metal layers are stacked is formed in a peripheral portion of one or both of an element substrate over which an electroluminescent element (also referred to as "EL element") where a layer containing a material that exhibits electroluminescence is interposed between a pair of electrodes is provided and a sealing substrate that is to be bonded to the element substrate so as to face each other. Further, the sheet is irradiated with a focused beam, and the irradiation portion of the sheet is heated, whereby at least two kinds of metals are alloyed, and the element substrate and the sealing substrate are bonded to each other by heat generated in the alloying.

The sheet used for bonding the element substrate and the sealing substrate to each other is preferably a sheet in which at least two kinds of metal layers are stacked and a plurality of layers of at least two kinds of metals are alternately stacked. When such a metal sheet is heated, an alloying reaction occurs and high reaction heat is generated depending on a combination of metal materials. Accordingly, part of such a metal sheet is heated to temperature at which alloying reaction thereof occurs, whereby heat generated by the alloying reaction is also conducted to other parts of the metal sheet, and thus the entire sheet can be alloyed. Since the reaction heat generated by the alloying reaction becomes higher than or equal to 1000° C. instantaneously, a surface of a glass substrate is melted by the heat generation, and the element substrate and the sealing substrate can be fused together using the sealant.

In the present invention, in order to form a sealing structure of an electroluminescent device, reaction heat generated by synthesis of a metal compound in forming a sealant is used. When the metal compound is synthesized, reaction heat is generated at several tens of kilojoules per mole to several hundreds of kilojoules per mole. An exothermic reaction in the synthesis of the metal compound progresses in a chain reaction manner, whereby the entire seal pattern can be alloyed without heating the entire sheet in which different kinds of metals are stacked, and the element substrate and the sealing substrate can be fused together using the sealant by the reaction heat.

Accordingly, for the seal pattern for forming a sealing structure, a variety of materials can be used as long as a combination of the materials which are alloyed by an exothermic reaction is used. Examples of such a combination of the materials include aluminum (Al) and nickel (Ni); aluminum (Al) and titanium (Ti); aluminum (Al) and silicon (Si); titanium (Ti) and nickel (Ni); titanium (Ti) and carbon (C); and the like.

In the above, a solder layer containing tin (Sn) or the like may be formed in a region which overlaps with the sheet in which different kinds of metals are stacked (i.e., a peripheral portion of the element substrate and/or the sealing substrate). Even when shrinkage in the volume of the sheet in which different kinds of metals are stacked occurs by melting and solidifying through the alloying reaction of the sheet in which different kinds of metals are stacked, a solder in the solder layer can flow into and fill a crack for due to the shrinkage. Thus, when the element substrate and the sealing substrate are bonded to each other, a highly airtight sealant can be formed.

Instead of the solder layer, a frit glass paste may be applied to the region which overlaps with the sheet in which different kinds of metals are stacked (i.e., a peripheral portion of the element substrate and/or the sealing substrate). Also in this case, even when shrinkage in the volume of the sheet in which different kinds of metals are stacked occurs by melting and solidifying through the alloying reaction of the sheet in which different kinds of metals are stacked, the frit glass paste can flow into a crack, so that a highly airtight sealant can be formed.

In the above, a glass ribbon may be formed in advance in the region which overlaps with the sheet in which different kinds of metals are stacked (i.e., the peripheral portion of the element substrate and/or the sealing substrate). As the glass ribbon, a glass having a low softening point is preferably used, which also enables a highly airtight sealant to be formed as described above.

The EL element is an element where a layer containing a material that exhibits electroluminescence is interposed between a pair of electrodes (an anode and a cathode), and a typical EL element includes one or plural layers each containing an organic material between a pair of electrodes.

In this specification, an element substrate refers to a substrate over which an EL element is fainted and includes, in its category, a substrate over which an active element such as a transistor and/or a passive element such as a resistor is formed and a substrate on which an IC chip is mounted.

Further, a sealing substrate is a substrate which has a size capable of covering a region of the element substrate where the EL element is formed and is bonded to the element substrate. Note that an active element such as a transistor and/or a passive element such as a resistor, or an IC chip may be also formed over a sealing substrate.

According to one embodiment of the present invention, the sheet in which different kinds of metals are stacked is used, and reaction heat generated when the alloying reaction of the sheet in which different kinds of metals are stacked occurs is used, whereby the element substrate and the sealing substrate can be fused together using the sealant and fixed. Although the reaction heat becomes very high instantaneously, the amount of the heat does not increase to the extent that the entire element substrate has high temperature. Accordingly, the EL element can be sealed between the element substrate and the sealing substrate without causing thermal damage to the EL element formed over the element substrate.

When heat generation occurs at one or plural points of the sheet in which different kinds of metals are stacked, the alloying reaction of the sheet in which different kinds of metals are stacked progresses in a chain reaction manner, and the entire sheet in which different kinds of metals are stacked, which is formed as a seal pattern, is alloyed instantly, so that the element substrate and the sealing substrate can be bonded to each other. As described above, since an entire region where the seal pattern is formed does not need to be heated at high temperature, productivity of the electroluminescent device can be improved.

Such a sealing member formed using an inorganic metal material prevents moisture from entering a panel and deterioration of the EL element can be prevented, so that the reliability of the electroluminescent device can be enhanced.

DETAILED DESCRIPTION OF THE INVENTION

Figure 1A:
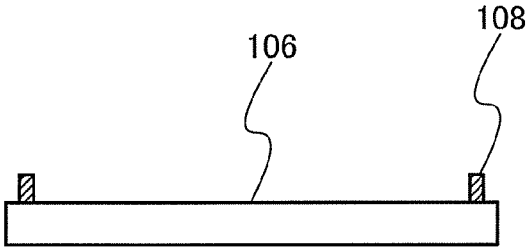
FIGS. 1A to 1E are views illustrating a mode in which an element substrate and a sealing substrate are bonded to each other with a sheet in which different kinds of metals are stacked.

Embodiments of the disclosed invention will be described with reference to drawings. Note that the disclosed invention is not limited to the following embodiments, and it is apparent to those skilled in the art that modes and details can be modified in a wide variety of ways without departing from the spirit and scope of the disclosed invention. Therefore, the disclosed invention is not interpreted as being limited to the description of the embodiments below.

Further, in embodiments hereinafter described, the same parts are denoted with the same reference numerals throughout the drawings. Note that components illustrated in the drawings, that is, a thickness or a width of a layer, a region, or the like, a relative position, and the like are exaggerated in some cases for clarification in description of embodiments.

Embodiment 1

Figure 1B:
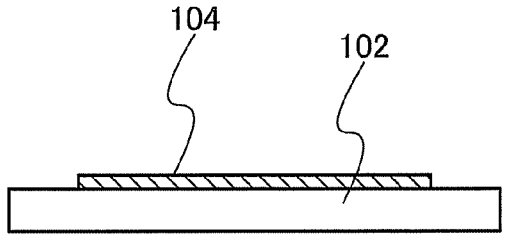
Figure 1C:
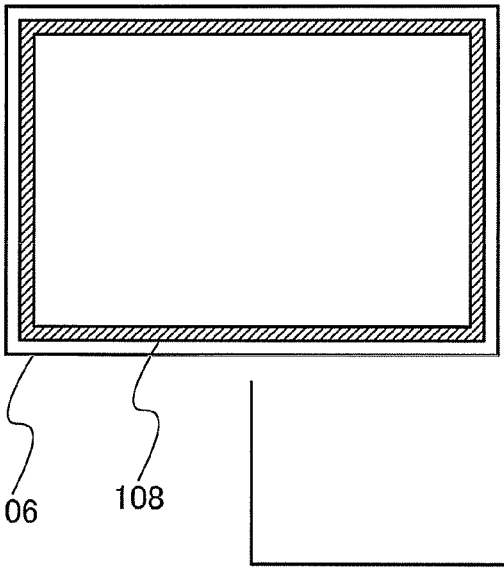
Figure 1D:
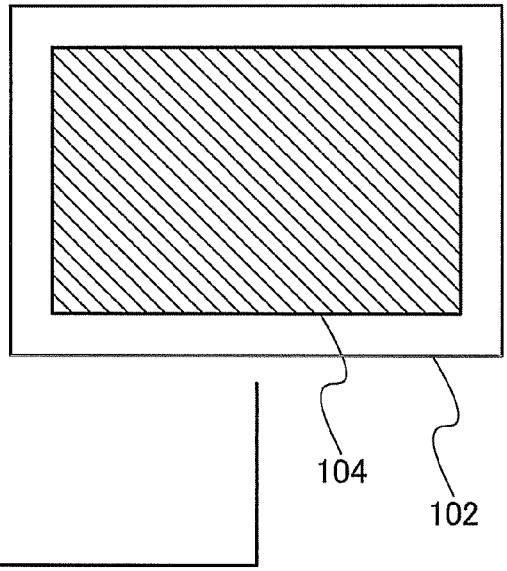

FIGS. 1A to 1E illustrate a mode in which an element substrate 102 over which an EL element 104 is formed and a sealing substrate 106 over which a sheet 108 in which different kinds of metals are stacked is formed are bonded to each other to manufacture an electroluminescent device (hereinafter, also referred to as an EL device). FIG. 1C is a top view of the sealing substrate 106, and FIG. 1A is a cross-sectional view of the sealing substrate 106. FIG. 1D is a top view of the element substrate 102, and FIG. 1B is a cross-sectional view of the element substrate 102. The sheet 108 in which different kinds of metals are stacked is formed in a peripheral portion of the sealing substrate 106 so as not to overlap with a region where the EL element 104 is formed.

After the element substrate 102 and the sealing substrate 106 are superposed on each other, a region where the sheet 108 in which different kinds of metals are stacked is formed is irradiated with a focused beam (see FIG. 1E), and the irradiation portion is heated. By the heat treatment performed on part of the sheet 108 in which different kinds of metals are stacked, an alloying reaction between the different kinds of metals occurs. By reaction heat generated by the alloying reaction, the alloying reaction progresses in the entire sheet 108 in which different kinds of metals are stacked in a chain reaction manner. Therefore, one portion of the sheet 108 in which different kinds of metals are stacked may be heated by irradiation with a focused beam. It is needless to say that plural portions of the sheet 108 in which different kinds of metals are stacked may be irradiated with a focused beam so that the entire sheet 108 in which different kinds of metals are stacked is alloyed faster.

Any focused beam may be employed as long as it is light that passes through a glass of a material of the element substrate 102, has a wavelength capable of being absorbed by a metal material, and has an energy density capable of melting the metal material. An example of a preferable focused beam is a laser beam, and an Nd: YAG laser or the like is preferably used. The laser light source is not limited thereto, and another laser light source can be used as long as it can heat the sheet 108 in which different kinds of metals are stacked.

Figure 1E:
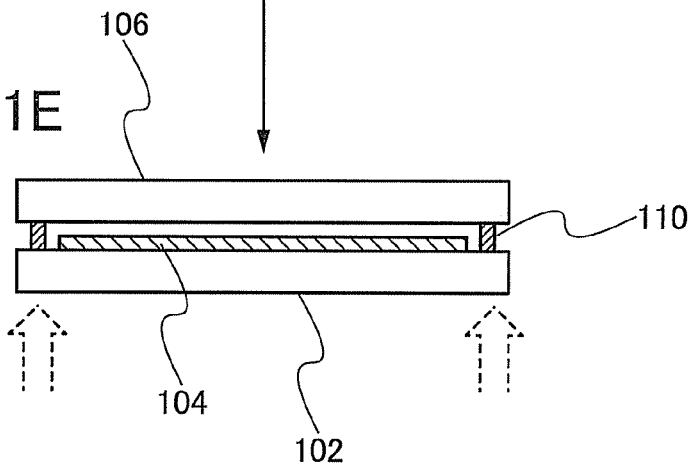
Figure 2A:
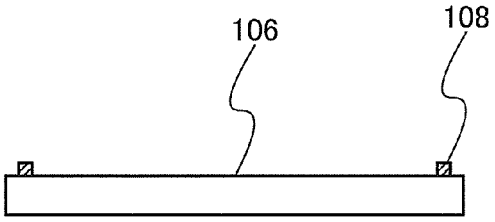
FIGS. 2A to 2E are views illustrating a mode in which an element substrate and a sealing substrate are bonded to each other with a sheet in which different kinds of metals are stacked and a solder layer.
Figure 2B:
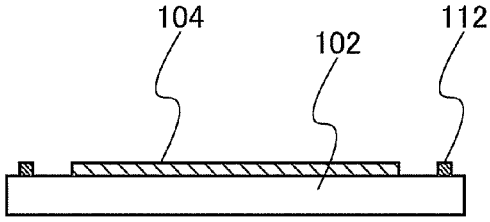
Figure 2C:
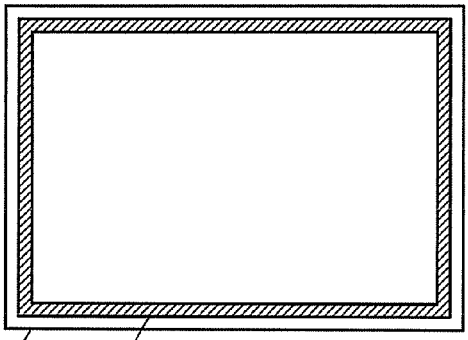
Figure 2D:
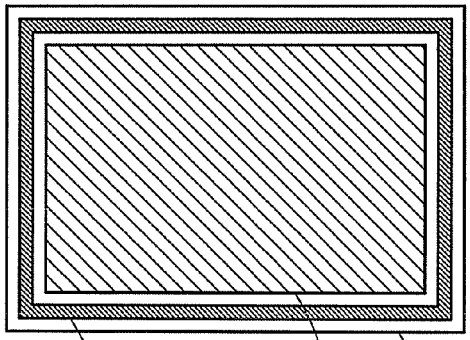
Figure 2E:
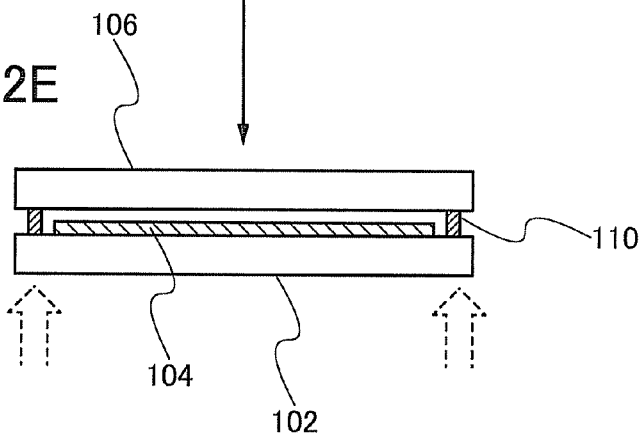
Figure 3A:
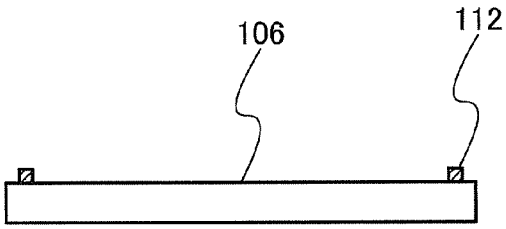
FIGS. 3A to 3F are views illustrating a mode in which solder layers are provided over an element substrate and a sealing substrate and both the substrates are bonded to each other with a sheet in which different kinds of metals are stacked interposed therebetween.
Figure 3B:
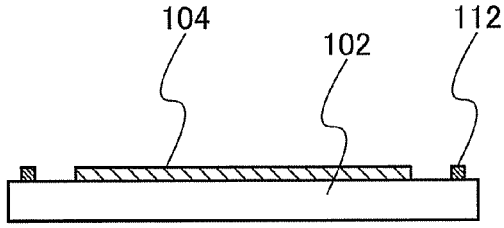
Figure 3C:
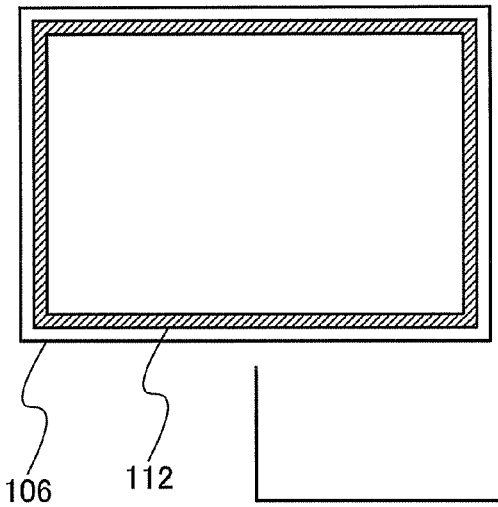
Figure 3D:
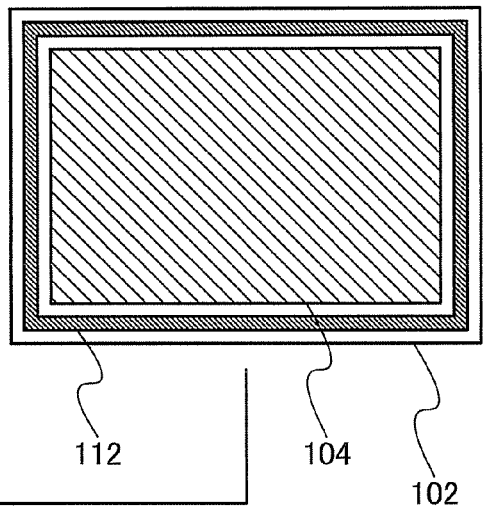
Figure 3E:
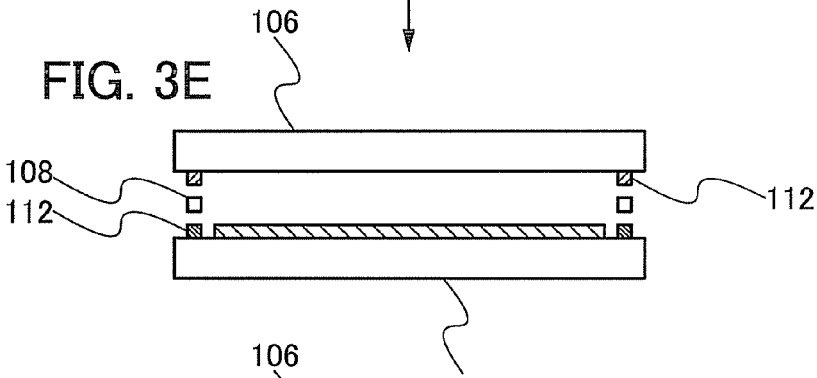
Figure 3F:
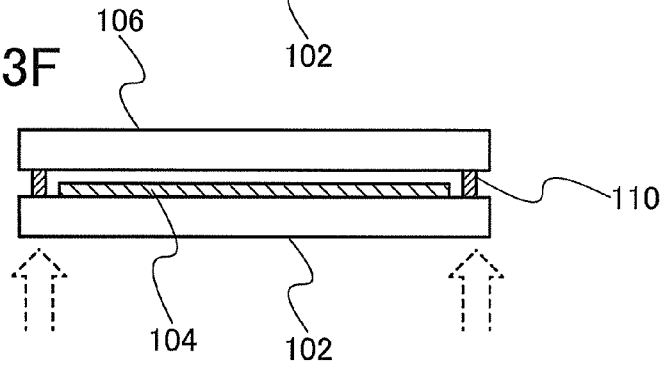
Figure 4A:
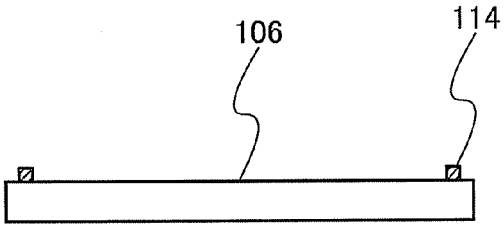
FIGS. 4A to 4F are views illustrating a mode in which frit glass pastes are provided over an element substrate and a sealing substrate and both the substrates are bonded to each other with a sheet in which different kinds of metals are stacked interposed therebetween.
Figure 4B:
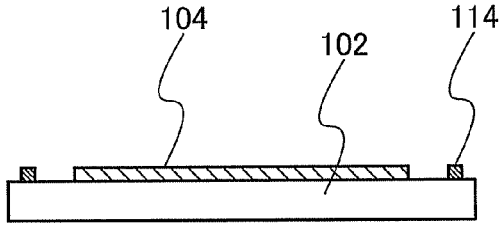
Figure 4C:
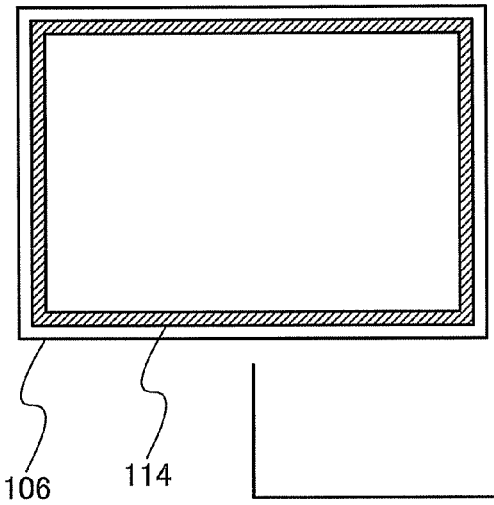
Figure 4D:
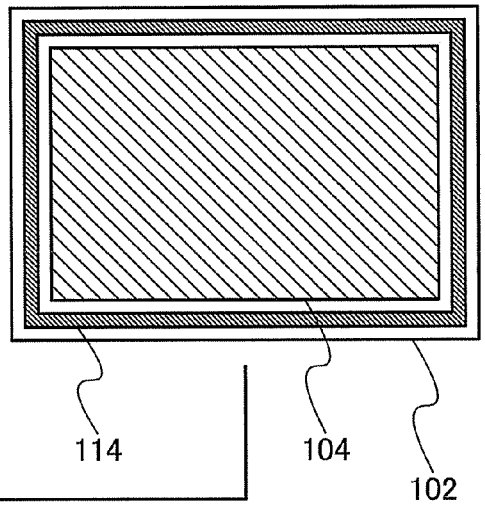
Figure 4E:
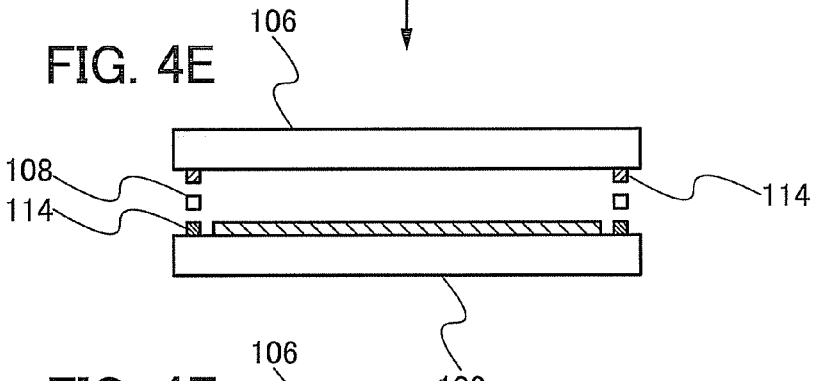
Figure 4F:
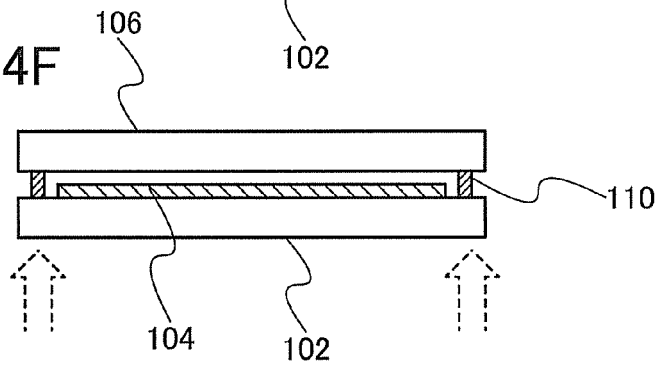
Figure 5A:
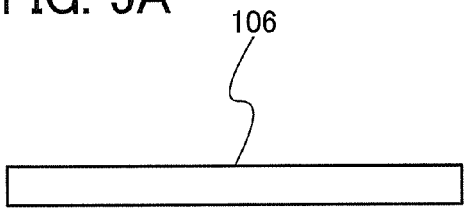
FIGS. 5A to 5F are views illustrating a mode in which frit glass pastes are provided on a top surface and a bottom surface of a sheet in which different kinds of metals are stacked and an element substrate and a sealing substrate are bonded to each other.
Figure 5B:
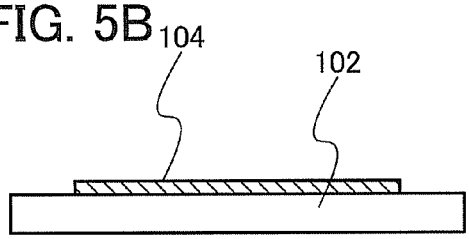
Figure 5C:
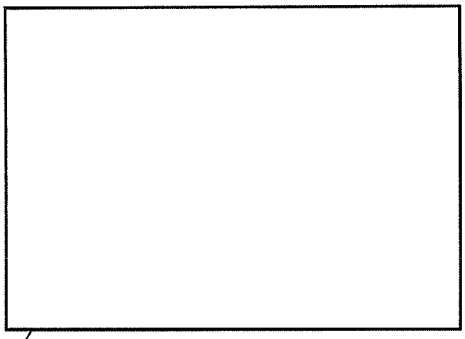
Figure 5D:
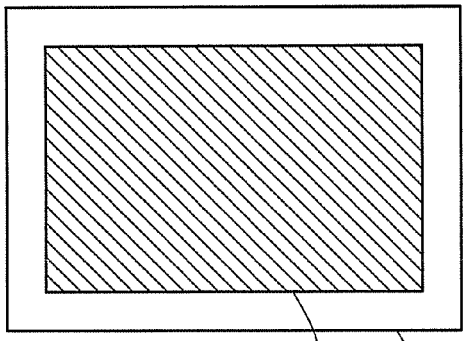
Figure 5D:
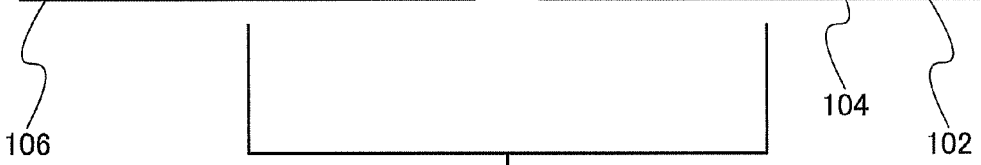
Figure 5E:
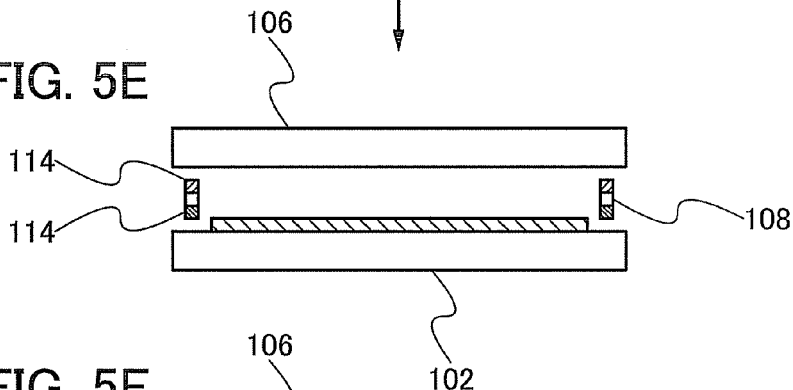
Figure 5F:
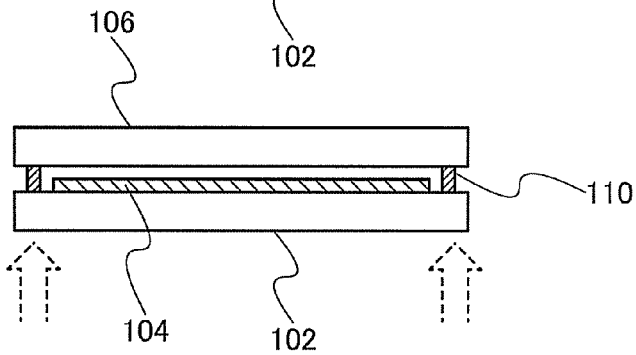
Figure 6A:
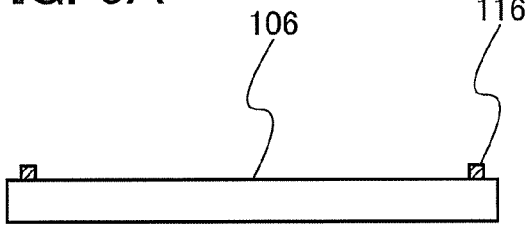
FIGS. 6A to 6F are views illustrating a mode in which glass ribbons are provided over an element substrate and a sealing substrate and both the substrates are bonded to each other with a sheet in which different kinds of metals are stacked interposed therebetween.
Figure 6B:
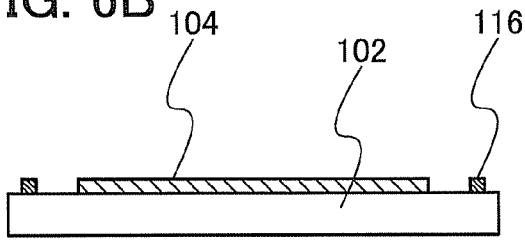
Figure 6C:
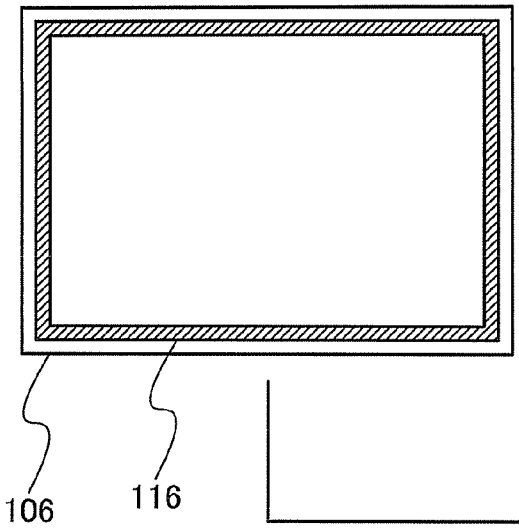
Figure 6D:
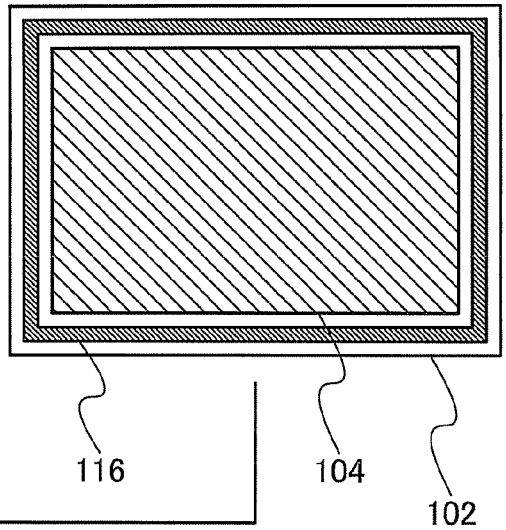
Figure 6E:
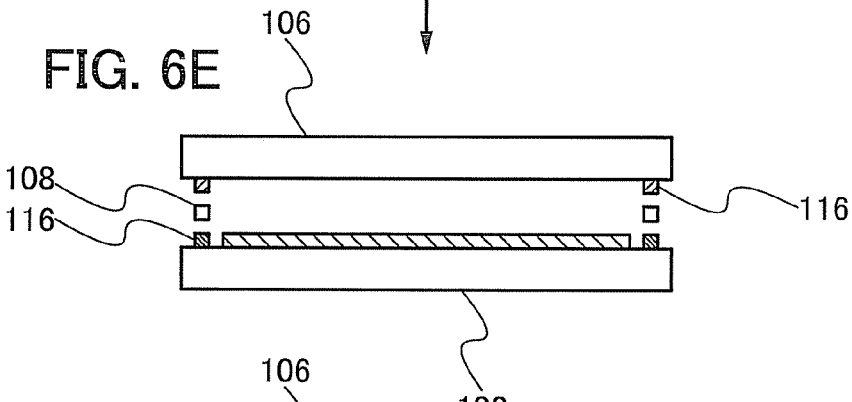
Figure 6F:
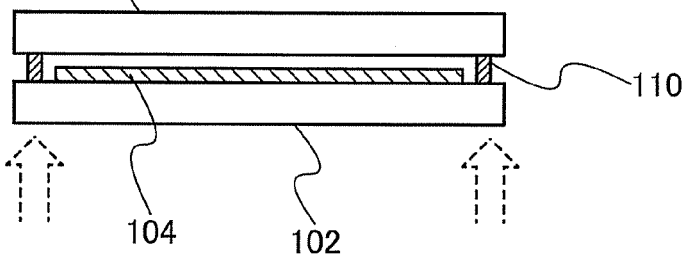

The sheet 108 in which different kinds of metals are stacked may be irradiated with the focused beam through the element substrate 102 as illustrated in FIG. 1E. Alternatively, side surfaces of the sheet 108 in which different kinds of metals are stacked may be directly irradiated with the focused beam in a state where the sheet 108 in which different kinds of metals are stacked is interposed between the element substrate 102 and the sealing substrate 106. A method for the alloying reaction of the sheet 108 in which different kinds of metals are stacked is not limited to the irradiation with the focused beam, and the alloying reaction may be generated by mechanical impact or frictional heat generated partially.

As materials included in the sheet 108 in which different kinds of metals are stacked, a variety of materials can be selected; however, it is preferable that a combination which causes an exothermic reaction in the alloying be used. Examples of such a combination includes aluminum (Al) and nickel (Ni); aluminum (Al) and titanium (Ti); titanium (Ti) and nickel (Ni); and the like. Further, materials included in the sheet 108 in which different kinds of metals are stacked are not limited to metal materials. Materials which react with a metal to cause the exothermic reaction can also be used. Examples of such a combination includes aluminum (Al) and silicon (Si); titanium (Ti) and carbon (C); and the like.

The sheet 108 in which different kinds of metals are stacked is preferably formed to have a structure in which thin metal layers are alternately stacked so that the sheet 108 in which different kinds of metals are stacked is alloyed by being at least partially heated, and after that, the alloying reaction of the sheet 108 in which different kinds of metals are stacked progresses in a chain reaction manner by the reaction heat generated in the alloying. For example, a sheet with a total thickness of approximately 40 μm obtained in such a manner that an aluminum layer and a nickel layer with thickness of 50 nm are alternatively stacked can be used. In the case where the sheet in which an aluminum layer and a nickel layer are alternatively stacked is used, an alloying reaction of the sheet in which extremely thin layers of different kinds of metals are alternatively stacked occurs at approximately 200° C.; therefore, heat treatment with the focused beam for causing the alloying reaction can be performed very easily.

The sheet 108 in which different kinds of metals are stacked is alloyed, whereby a sealant 110 with which the element substrate 102 and the sealing substrate 106 are fused together is formed. When the element substrate 102 and the sealing substrate 106 are bonded to each other through this step, a space between both the substrates is preferably filled with a gas containing moisture as little as possible, such as dry air or dry nitrogen. Further, the EL element 104 is sealed by bonding the element substrate 102 and the sealing substrate 106 to each other under a reduced pressure (in vacuum), whereby the space between both the substrates can be maintained in vacuum. Thus, the EL element 104 which is interposed between the element substrate 102 and the sealing substrate 106 and sealed with the sealant 110 can be prevented from deteriorating due to moisture or the like.

In a region of the element substrate 102 where the EL element 104 is formed, a plurality of EL elements may be arranged in a matrix, and characters, diagrams, signs, or images (including a still image and a moving image) may be displayed. In this case, it is possible to provide a circuit for driving the matrix display portion in the region over the element substrate 102, in which case, the driving circuit can be also formed on an inner side of a sealing frame which is the sheet 108 in which different kinds of metals are stacked.

FIGS. 1A to 1E illustrate an example where the sealing frame of the sheet 108 in which different kinds of metals are stacked is provided on the sealing substrate side; however, the sheet 108 in which different kinds of metals are stacked can also be provided on the element substrate side or on both of the element substrate 102 side and the sealing substrate 106 side.

FIGS. 2A to 2E illustrate a mode in which the sheet 108 in which different kinds of metals are stacked is provided in the peripheral portion of the sealing substrate 106, a solder layer 112 is provided in a peripheral portion of the element substrate 102, and the element substrate 102 and the sealing substrate 106 are bonded to each other as described above. As the solder layer 112, a layer containing tin (Sn) can be used. For example, any of a combination of tin (Sn) and silver (Ag), a combination of tin (Sn) and copper (Cu), a combination of tin (Sn) and bismuth (Bi), and the like can be used.

As described above, the solder layer 112 having a low melting point is provided, whereby even when shrinkage in the volume of the sheet 108 in which different kinds of metals are stacked occurs and a crack is generated in a process of melting and solidifying through the alloying reaction of the sheet 108 in which different kinds of metals are stacked, the solder of the solder layer can flow into and fill the crack. Thus, when the element substrate and the sealing substrate are bonded to each other, the highly airtight sealant 110 can be formed.

FIGS. 3A to 3F illustrate a mode in which both the sealing substrate 106 and the element substrate 102 are provided with the solder layers 112, and the element substrate 102 and the sealing substrate 106 are bonded to each other with the sheet 108 in which different kinds of metals are stacked interposed therebetween. The sheet 108 in which different kinds of metals are stacked are interposed between the solder layers 112, whereby in a manner similar to the mode illustrated in FIGS. 2A to 2E, even when shrinkage in the volume of the sheet 108 in which different kinds of metals are stacked occurs and a crack is generated in the process of melting, and solidifying by the alloying reaction of the sheet 108 in which different kinds of metals are stacked, the solder of the solder layers can flow into and fill the crack.

FIGS. 4A to 4F illustrate a mode in which both the sealing substrate 106 and the element substrate 102 are provided with frit glass pastes 114, and the element substrate 102 and the sealing substrate 106 are bonded to each other with the sheet 108 in which different kinds of metals are stacked interposed therebetween. FIGS. 5A to 5F illustrate a mode in which a top surface and a bottom surface of the sheet 108 in which different kinds of metals are stacked are provided with the frit glass pastes 114, and the sealing substrate 106 and the element substrate 102 are bonded to each other with the sheet 108 in which different kinds of metals are stacked and which is provided with the frit glass pastes 114 interposed therebetween.

The frit glass paste is a glass into which at least one kind of a transition metal and a filler for lowering a thermal expansion coefficient so that the frit glass paste is softened when heated to form a bonding portion are added. It is preferable that the filler for lowering a thermal expansion coefficient be added so that the thermal expansion coefficient of the frit glass paste is substantially the same as that of a material of the substrate. For example, the thermal expansion coefficient of the frit glass paste is preferably higher than or equal to $1\times10^{-6}$/° C. and lower than or equal to $8\times10^{-6}$/° C. Further, the frit glass paste is preferably softened at temperature lower than the strain points of the substrates (the sealing substrate and the element substrate). For example, the glass transition point of the frit glass paste is preferably lower than or equal to 500° C. and the softening point thereof is preferably lower than or equal to 600° C. As an example of the frit glass paste, a glass containing $SiO_2$, $B_2O_3$, or PbO as its component and having a thermal expansion coefficient of $7.9\times10^{-6}$/° C., a glass transition point of 340° C., and a softening point of 405° C., can be given. Note that the frit glass paste is not limited to the glass having the above-described composition, and the frit glass paste may be formed using other materials as long as it has a property similar to the above-described composition.

As illustrated in FIGS. 4A to 4F and FIGS. 5A to 5F, the sheet 108 in which different kinds of metals are stacked are interposed between the frit glass pastes 114 instead of the solder layer, whereby even when shrinkage in the volume of the sheet 108 in which different kinds of metals are stacked occurs and a crack is generated in the process of melting and solidifying by the alloying reaction of the sheet 108 in which different kinds of metals are stacked, the frit glass paste can flow into and fill the crack.

FIGS. 6A to 6F illustrate a mode in which both the sealing substrate 106 and the element substrate 102 are provided with glass ribbons 116, and the sealing substrate 106 and the element substrate 102 are bonded to each other with the sheet 108 in which different kinds of metals are stacked interposed therebetween. The glass ribbon 116 may be formed in advance in a region which overlaps with the sheet 108 in which different kinds of metals are stacked (i.e., the peripheral portion of the element substrate 102 and/or the sealing substrate 106). As the glass ribbon 116, a glass whose softening point is lower than the strain points of the substrates (the sealing substrate and the element substrate), for example, lower than or equal to 600° C., is preferably used. Further, the surface roughness of the glass ribbon 116 is preferably less than or equal to 2.0 nm. Furthermore, the difference between the thermal expansion coefficient of each of the substrates (the sealing substrate and the element substrate) and the thermal expansion coefficient of the glass ribbon 116 is preferably lower than or equal to $5\times10^{-7}$/° C. when the temperatures of the glass ribbon 116 and the substrates are 27° C. to 380° C. For example, the thermal expansion coefficient of the glass ribbon 116 is preferably higher than or equal to $1\times10^{-6}$/° C. and lower than or equal to $8\times10^{-6}$/° C. This also enables the highly airtight sealant 110 to be formed as described above.

The structures, methods, and the like described in this embodiment can be combined as appropriate with any of the structures, methods, and the like described in the other embodiments.

Embodiment 2

Figure 7A:
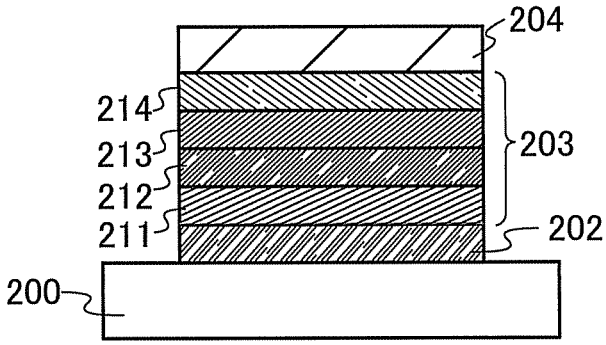
FIGS. 7A and 7B are conceptual diagrams each illustrating an electroluminescent element according to one embodiment of the present invention.

One embodiment of a structure which can be applied to the EL element described in Embodiment 1 will be described with reference to FIGS. 7A and 7B. In this embodiment, as the EL element, a structure of a light-emitting element including an organic EL layer between a pair of electrodes will be described in detail.

The light-emitting element described in this embodiment includes a pair of electrodes (a first electrode 202 and a second electrode 204) and an organic EL layer 203 interposed between the pair of electrodes. The light-emitting element described in this embodiment is provided over a glass substrate 200.

The glass substrate 200 is used as a support of the light-emitting element. As the glass substrate 200, it is needless to say that a rectangular plate-like substrate can be used, and substrates having a variety of shapes, such as a shape having a curved surface, can be used.

One of the first electrode 202 and the second electrode 204 serves as an anode and the other serves as a cathode. In this embodiment, the first electrode 202 is used as the anode and the second electrode 204 is used as the cathode; however, the present invention is not limited to this structure.

It is preferable to use a metal, an alloy, or a conductive compound, a mixture thereof, or the like having a high work function (specifically, more than or equal to 4.0 eV) as a material for the anode. Specific examples include indium oxide-tin oxide, indium oxide-tin oxide containing silicon or silicon oxide, indium oxide-zinc oxide, and indium oxide containing tungsten oxide and zinc oxide, and the like. In addition, gold (Au), platinum (Pt), nickel (Ni), tungsten (W), chromium (Cr), molybdenum (Mo), iron (Fe), cobalt (Co), copper (Cu), palladium (Pd), a nitride of a metal material (such as titanium nitride), or the like can be used.

It is preferable to use a metal, an alloy, or a conductive compound, a mixture thereof, or the like having a low work function (specifically, less than or equal to 3.8 eV) as a material for the cathode. Specifically, an element belonging to Group 1 or 2 of the periodic table, that is, an alkali metal such as lithium (Li) and cesium (Cs), an alkaline earth metal such as calcium (Ca) and strontium (Sr), and magnesium (Mg) can be given. Further, an alloy including an alkali metal or an alkaline earth metal (e. g., MgAg or AlLi) can be used. Moreover, a rare earth metal such as europium (Eu) or ytterbium (Yb), or an alloy containing a rare earth metal can also be used. In the case where an electron-injection layer in contact with the second electrode 204 is provided as part of the organic EL layer 203, the second electrode 204 can be formed using any of a variety of conductive materials such as Al, Ag or indium oxide-tin oxide, regardless of their work functions. These conductive materials can be formed by a sputtering method, an inkjet method, a spin coating method, or the like.

Although the organic EL layer 203 can be formed to have a single-layer structure, it is normally formed to have a stacked-layer structure. There is no particular limitation on the stacked-layer structure of the organic EL layer 203. It is possible to combine, as appropriate, a layer containing a substance having a high electron-transport property (an electron-transport layer) or a layer containing a substance having a high hole-transport property (a hole-transport layer), a layer containing a substance having a high electron-injection property (an electron-injection layer), a layer containing a substance having a high hole-injection property (a hole-injection layer), a layer containing a bipolar substance (a substance having high electron- and hole-transport properties), a layer containing a light-emitting material (a light-emitting layer), and the like. For example, the organic EL layer 203 can be formed in an appropriate combination of a hole-injection layer, a hole-transport layer, a light-emitting layer, an electron-transport layer, an electron-injection layer, and the like. FIG. 7A illustrates, as the organic EL layer 203 formed over the first electrode 202, a structure in which a hole-injection layer 211, a hole-transport layer 212, a light-emitting layer 213, and an electron-transport layer 214 are sequentially stacked.

In the light-emitting element, a current flows due to a potential difference made between the first electrode 202 and the second electrode 204, a hole and an electron are recombined in the light-emitting layer 213, which contains a substance having a high light-emitting property, and light is emitted. In other words, the light-emitting element has a structure in which a light-emitting region is formed in the light-emitting layer 213.

The emitted light is extracted out through one or both of the first electrode 202 and the second electrode 204. Therefore, one or both of the first electrode 202 and the second electrode 204 are electrodes having a light-transmitting property. When only the first electrode 202 is an electrode having a light-transmitting property, light is extracted from the glass substrate 200 side through the first electrode 202. Meanwhile, when only the second electrode 204 is an electrode having a light-transmitting property, light is extracted from a side opposite to the glass substrate 200 side through the second electrode 204. When both the first electrode 202 and the second electrode 204 are electrodes having a light-transmitting property, light is extracted from both the glass substrate 200 side and the side opposite to the glass substrate 200 side through the first electrode 202 and the second electrode 204.

In order to suppress energy transfer from an exciton which is generated in the light-emitting layer 213, the hole-transport layer 212 or the electron-transport layer 214 which is in contact with the light-emitting layer 213, particularly a carrier- (electron- or hole-) transport layer in contact with a side closer to a light-emitting region in the light-emitting layer 213, is preferably formed using a substance having an energy gap larger than an energy gap of a light-emitting material contained in the light-emitting layer or an energy gap of an emission center substance contained in the light-emitting layer.

The hole-injection layer 211 contains a substance having a high hole-injection property, and has a function of helping injection of holes from the first electrode 202 to the hole-transport layer 212. The hole-injection layer 211 is formed so that a difference in ionization potential between the first electrode 202 and the hole-transport layer 212 is relieved, and thus holes are easily injected. Specifically, it is preferable that the hole-injection layer 211 be formed to have a smaller ionization potential than that of the hole-transport layer 212 and to have a larger ionization potential than that of the first electrode 202, or it is preferable that the hole-injection layer 211 be formed using a substance in which an energy band is bent when the substance is provided as a thin film with a thickness of 1 nm to 2 nm between the hole-transport layer 212 and the first electrode 202. Specific examples of substances having a high hole-injection property include phthalocyanine (abbreviation: $H_2Pc$), a phthalocyanine-based compound such as copper phthalocyanine (abbreviation: CuPc), a high molecular compound such as poly(ethylenedioxythiophene)/poly(styrenesulfonate) aqueous solution (PEDOT/PSS), and the like.

The hole-transport layer 212 contains a substance having a high hole-transport property. Note that a substance having a high hole-transport property refers to a substance having higher mobility of holes than that of electrons and a substance having a ratio value of hole mobility to electron mobility (=hole mobility/electron mobility) of more than 100 is preferably used. The hole-transport layer 212 preferably has a hole mobility of greater than or equal to $1\times10^{-6}$ $cm^2/Vs$. As a material having a high hole transport property, specifically, 4,4'-bis[N-(1-naphthyl)-N-phenylamino]biphenyl (abbreviation: NPB), 4,4'-bis[N-(3-methylphenyl)-N-phenylamino]biphenyl (abbreviation: TPD), 4,4',4"-tris(N,N-diphenylamino)triphenylamine (abbreviation: TDATA), 4,4',4"-tris[N-(3-methylphenyl)-N-phenylamino]triphenylamine (abbreviation: MTDATA), 4,4'-bis{N-[4-(N,N-di-m-tolylamino)phenyl]-N-phenylamino}biphenyl (abbreviation: DNTPD), 1,3,5-tris[N,N-di(m-tolyl)amino]benzene (abbreviation: m-MTDAB), 4,4',4"-tris(N-carbazolyl)triphenylamine (abbreviation: TCTA), phthalocyanine (abbreviation: $H_2Pc$), copper phthalocyanine (abbreviation: CuPc), vanadyl phthalocyanine (abbreviation: VOPc), and the like are given. Note that the hole-transport layer 212 may have a single-layer structure or a stacked-layer structure.

The electron-transport layer 214 contains a substance having a high electron-transport property. Note that a substance having a high electron-transport property refers to a substance having higher mobility of electrons than that of holes and a substance in which the value of the ratio of the electron mobility to the hole mobility (=electron mobility/hole mobility) is more than 100 is preferably used. The electron-transport layer 214 preferably has an electron mobility of greater than or equal to $1\times10^{-6}$ $cm^2/Vs$. Specific examples of the substances having a high electron-transport property include a metal complex having a quinoline skeleton, a metal complex having a benzoquinoline skeleton, a metal complex having an oxazole-based ligand, and a metal complex having a thiazole-based ligand. Specific examples of metal complexes having a quinoline skeleton include tris(8-quinolinolato)aluminum (abbreviation: Alq), tris(4-methyl-8-quinolinolato) aluminum (abbreviation: $Almq_3$), and bis(2-methyl-8-quinolinolato)(4-phenylphenolato)aluminum (abbreviation: BAlq). A specific example of a metal complex having a benzoquinoline skeleton is bis(10-hydroxybenzo[h]quinolinato) beryllium (abbreviation: $BeBq_2$). A specific example of a metal complex having an oxazole-based ligand is bis[2-(2-hydroxyphenyl)benzoxazolato]zinc (abbreviation: $Zn(BOX)_2$). A specific example of a metal complex having a thiazole-based ligand is bis[2-(2-hydroxyphenyl)benzothiazolato]zinc (abbreviation: $Zn(BTZ)_2$). In addition to the metal complexes, 2-(4-biphenylyl)-5-(4-tert-butylphenyl)-1,3,4-oxadiazole (abbreviation: PBD), 1,3-bis[5-(p-tert-butylphenyl)-1,3,4-oxadiazole-2-yl]benzene (abbreviation: OXD-7), 3-(4-biphenylyl)-4-phenyl-5-(4-tent-butylphenyl)-1,2,4-triazole (abbreviation: TAZ 01), bathophenanthroline (abbreviation: BPhen), bathocuproine (BCP), or the like can be used. The substances specifically listed above are mainly substances having an electron mobility of more than or equal to $10^{-6}$ $cm^2/Vs$. Note that any substance other than the above substances may be used for the electron-transport layer 214 as long as the electron-transport property is higher than the hole-transport property. Further, the electron-transport layer 214 may have a single-layer structure or a stacked-layer structure.

Further, a layer for controlling transport of electron carriers may be provided between the light-emitting layer 213 and the electron-transport layer 214. Note that the layer for controlling transport of electron carriers is a layer obtained by adding a small amount of substance having a high electron-trapping property to the above-described material having a high electron-transport property. By providing the layer for controlling transport of electron carriers, it is possible to suppress transfer of electron carriers, and to adjust carrier balance. Such a structure is very effective in suppressing a problem (such as shortening of element lifetime) caused when electrons pass through the light-emitting layer.

In addition, an electron-injection layer may be provided between the electron-transport layer 214 and the second electrode 204, in contact with the second electrode 204. As the electron-injection layer, a layer which contains a substance having an electron-transport property and an alkali metal, an alkaline earth metal, magnesium (Mg), or a compound thereof such as lithium fluoride (LiF), cesium fluoride (CsF), or calcium fluoride ($CaF_2$) may be used. Specifically, a layer containing Alq and magnesium (Mg) can be used. By providing the electron-injection layer, electrons can be injected efficiently from the second electrode 204.

Various methods can be used for forming the organic EL layer 203, regardless of a dry method or a wet method. For example, a vacuum evaporation method, an inkjet method, a spin-coating method, or the like can be used. When the organic EL layer 203 has a stacked-layer structure, deposition methods of the layers may be different or the same.

Further, the first electrode 202 and the second electrode 204 may be formed by a wet method such as a sol-gel method, a wet method using a liquid metal material, or a dry method such as a sputtering method or a vacuum evaporation method. When such a light-emitting element and the sealing method using the sheet in which different kinds of metals are stacked, which is one embodiment of the present invention, are combined, a highly reliable EL device can be manufactured.

The structures, methods, and the like described in this embodiment can be combined as appropriate with any of the structures, methods, and the like described in the other embodiments.

Embodiment 3

In this embodiment, a light-emitting element in which a plurality of light-emitting units are stacked (hereinafter this light-emitting element is referred to as a "tandem light-emitting element"), which is one embodiment of the present invention, will be described with reference to FIG. 7B. The tandem light-emitting element includes a plurality of light-emitting units between a first electrode and a second electrode. For the light-emitting units, a structure similar to that of the organic EL layer 203 described above can be used.

Figure 7B:
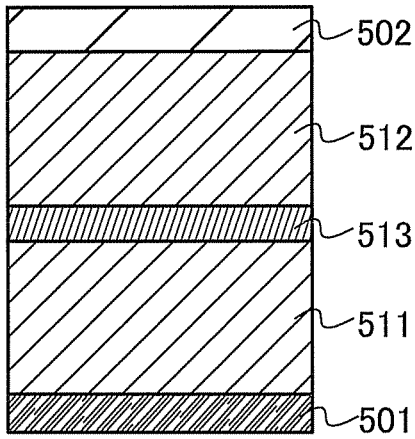

In FIG. 7B, a first light-emitting unit 511 and a second light-emitting unit 512 are stacked between a first electrode 501 and a second electrode 502. Electrodes similar to those described in Embodiment 2 can be used as the first electrode 501 and the second electrode 502. Further, the structures of the first light-emitting unit 511 and the second light-emitting unit 512 may be the same or different from each other, and each of the structures of the first and second light-emitting units 511 and 512 can be similar to the structure described in Embodiment 2.

A charge generation layer 513 is provided between the first light-emitting unit 511 and the second light-emitting unit 512. The charge generation layer 513 contains a composite material of an organic compound and a metal oxide and has a function of injecting electrons to one of the light-emitting units, and holes to the other of the light-emitting units, when voltage is applied between the first electrode 501 and the second electrode 502. The composite material of the organic compound and the metal oxide enables low-voltage driving and low-current driving because of its superior carrier-injection property and carrier-transport property.

As the hole-transport organic compound, an organic compound having a hole mobility of more than or equal to $10^{-6}$ $cm^2/Vs$ is preferably used. Specifically, as the hole-transport organic compound, an aromatic amine compound, a carbazole compound, aromatic hydrocarbon, and a macromolecular compound (an oligomer, a dendrimer, a polymer, or the like), or the like can be used. It is possible to use oxide of a metal belonging to Group 4 to Group 8 in the periodic table as the metal oxide mixed with the hole-transport organic compound; specifically, it is preferable to use any of vanadium oxide, niobium oxide; tantalum oxide, chromium oxide, molybdenum oxide, tungsten oxide, manganese oxide, and rhenium oxide because their electron-accepting property is high. In particular, molybdenum oxide is especially preferable because it is stable in the air, its hygroscopic property is low, and it can be easily handled.

The charge generation layer 513 may have a single-layer structure or a stacked-layer structure. For example, it is possible to have a stacked-layer structure of a layer containing a composite material of an organic compound and a metal oxide, and a layer containing one compound selected from electron-donating substances and a compound having a high electron-transport property; or a stacked-layer structure of a layer containing a composite material of an organic compound and a metal oxide, and a transparent conductive film.

In this embodiment, the light-emitting element having two light-emitting units is described; however, the present invention is not limited to this structure. In other words, a tandem light-emitting element may have three or more light-emitting units. Also in this case, a charge generation layer is provided between the light-emitting units. For example, it is also possible to form a light-emitting element having a first unit, a second unit formed using a first light-emitting material which emits light with a longer wavelength than the first unit (e.g., red light), and a third unit formed using a second light-emitting material which emits light with a longer wavelength than the first unit and a shorter wavelength than the first light-emitting material (e.g., green light). By using these light-emitting elements, an EL device which emits white light can be obtained.

Since the plurality of light-emitting units are partitioned by the charge generation layer between a pair of electrodes in the tandem light-emitting element, the tandem light-emitting element of this embodiment can emit light with high luminance while keeping a current density low. Since the current density can be low, the tandem light-emitting element can have high luminance and a long lifetime. When such a light-emitting element and the sealing method using the sheet in which different kinds of metals are stacked, which is one embodiment of the present invention, are combined, a highly reliable EL device can be manufactured.

The structures, methods, and the like described in this embodiment can be combined as appropriate with any of the structures, methods, and the like described in the other embodiments.

Embodiment 4

(Descriptions of Passive Matrix EL Device and Active Matrix EL Device)

In this embodiment, a passive matrix EL device and an active matrix EL device manufactured using the sheet in which different kinds of metals are stacked, which is one embodiment of the present invention, will be described.

FIGS. 8A to 8D and FIG. 9 illustrate an example of the passive matrix EL device.

In a passive matrix (also referred to as 'simple matrix') EL device, a plurality of anodes arranged in stripes (in stripe form) are provided to be perpendicular to a plurality of cathodes arranged in stripes, and a light-emitting layer is interposed at each intersection. Therefore, a pixel at an intersection of an anode selected (to which a voltage is applied) and a cathode selected emits light.

Figure 8A:
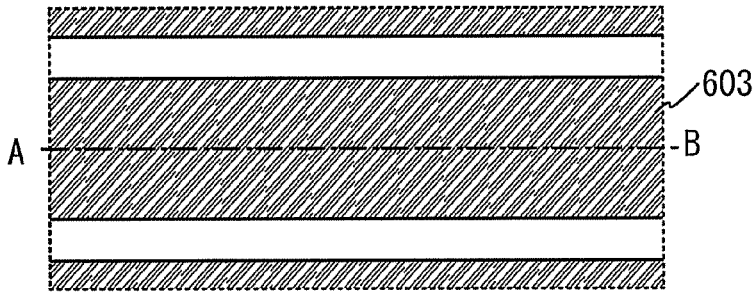
FIGS. 8A to 8D are views illustrating an example of an electroluminescent device according to one embodiment of the present invention.
Figure 8B:
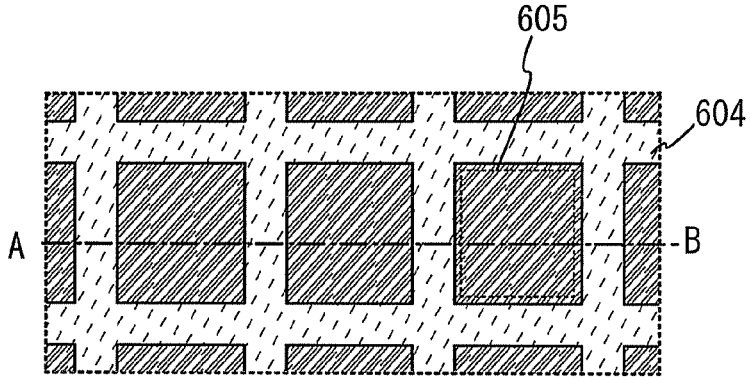
Figure 8C:
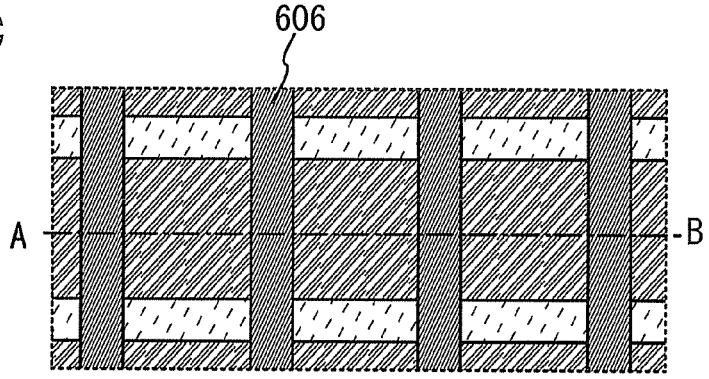
Figure 8D:
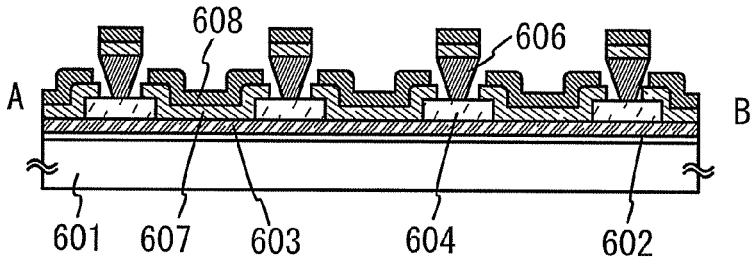

FIGS. 8A to 8C are plan views of a pixel portion before sealing, and FIG. 8D is a cross-sectional view taken along chain line A-B in FIGS. 8A to 8C.

Over a glass substrate 601, an insulating layer 602 is formed as a base insulating layer. Note that the insulating layer 602 may be omitted when unnecessary. Over the insulating layer 602, a plurality of first electrodes 603 is arranged in stripes at regular intervals (FIG. 8A). Note that each of the first electrodes 603 in this embodiment corresponds to the first electrode 202 in Embodiment 2.

In addition, a partition 604 having openings 605 corresponding to pixels is provided over the first electrodes 603. The partition 604 is formed using an insulating material. For example, polyimide, acrylic, polyamide, polyimide amide, a photosensitive or non-photosensitive organic material such as benzocyclobutene, or an SOG film such as an $SiO_x$ film that contains an alkyl group can be used as the insulating material. The opening 605 corresponding to each pixel is a light-emitting region (FIG. 8B).

Over the partition 604 having openings, a plurality of partitions 606 are provided to intersect with the first electrodes 603 (FIG. 8C). The plurality of partitions 606 is formed in parallel to each other, and inversely tapered.

Over each of the first electrodes 603 and the partition 604, an organic EL layer 607 and a second electrode 608 are sequentially stacked (FIG. 8D). Note that the organic EL layer 607 in this embodiment corresponds to the organic EL layer 203 in Embodiment 2, and the second electrode 608 in this embodiment corresponds to the second electrode 204 in Embodiment 2. The total height of the partition 604 and the partition 606 is larger than the total thickness of the organic EL layer 607 and the second electrode 608; therefore, the organic EL layer 607 and the second electrode 608 are divided into a plurality of regions as illustrated in FIG. 8D. Note that the plurality of divided regions are electrically isolated from one another.

The second electrode 608 intersects with the first electrodes 603 and is an electrode in stripe form. Note that when the organic EL layer 607 and the second electrode 608 are formed, layers similar to the organic EL layer 607 and the second electrode 608 are also formed over the inversely-tapered partitions 606; however, they are separated from the organic EL layers 607 and the second electrodes 608.

Next, as described in Embodiment 1, with the use of the sheet in which different kinds of metals are stacked and which is formed over the glass substrate 601, the glass substrate 601 and the sealing substrate are bonded to each other. Thus, deterioration of the light-emitting element can be significantly suppressed. Note that the sealed space may be filled with a dry filler or a dry inert gas. Further, a desiccant or the like may be included in the sheet in which different kinds of metals are stacked in order to prevent deterioration of the light-emitting element due to moisture or the like. The desiccant removes moisture in the sealed space, thereby achieving sufficient desiccation. As the desiccant, oxide of an alkaline earth metal such as calcium oxide or barium oxide, zeolite, silicagel, or the like can be used. Oxide of an alkaline earth metal adsorbs moisture by chemical adsorption, and zeolite and silicagel adsorb moisture by physical adsorption.

Figure 9:
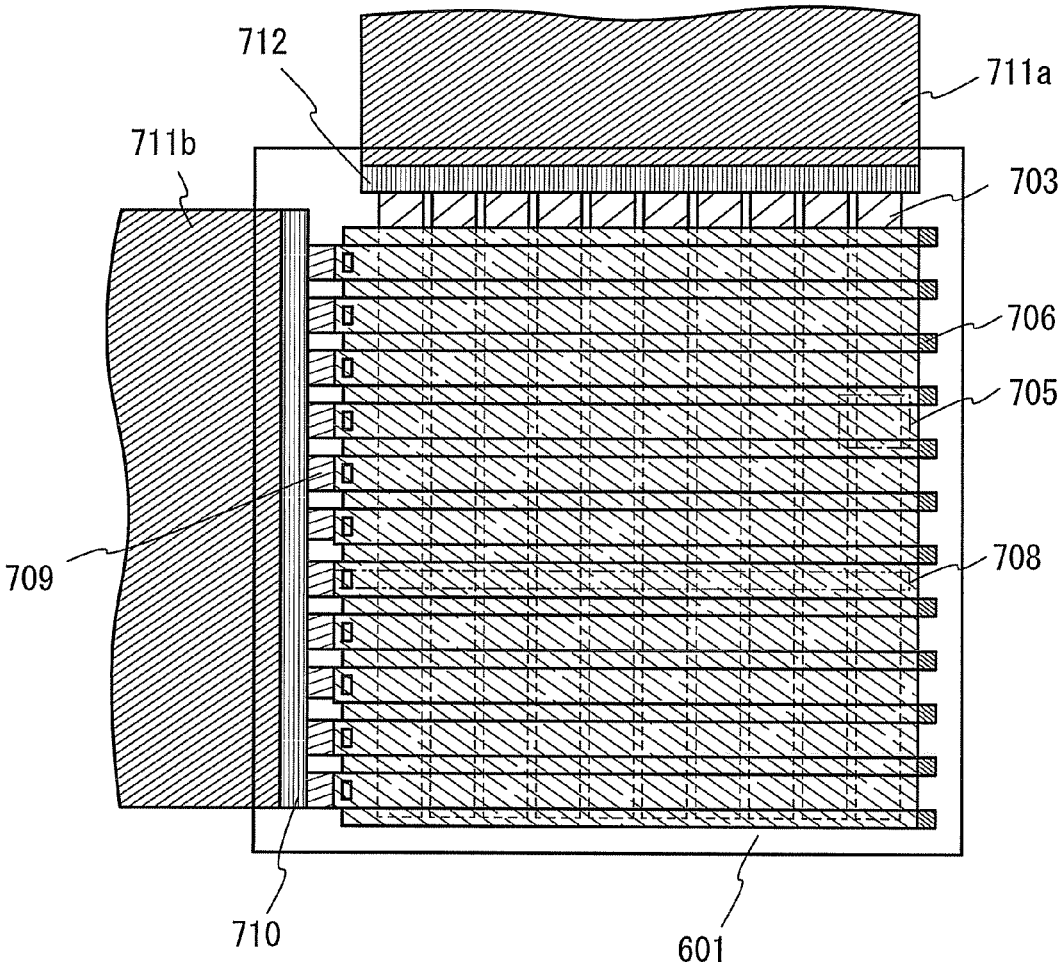
FIG. 9 is a view illustrating an example of an electroluminescent device according to one embodiment of the present invention.

FIG. 9 is a plan view of the passive matrix EL device illustrated in FIGS. 8A to 8D that is provided with a flexible printed circuit (an FPC) or the like.

In FIG. 9, scan lines and data lines intersect at right angles in the pixel portion for displaying images.

Here, the relation between FIGS. 8A to 8D and FIG. 9 is described. The first electrodes 603 in FIGS. 8A to 8D correspond to scan lines 703 in FIG. 9; the second electrodes 608 in FIGS. 8A to 8D correspond to data lines 708 in FIG. 9; and the inversely tapered partitions 606 in FIGS. 8A to 8D correspond to partitions 706 in FIG. 9. The organic EL layers 607 illustrated in FIG. 8D are interposed between the data lines 708 and the scan lines 703, and an intersection indicated by a region 705 corresponds to one pixel.

The data lines 708 are electrically connected at their ends to connection wirings 709 and the connection wirings 709 are connected to an FPC 711*b* through an input terminal 710. In addition, the scan lines 703 are connected to an FPC 711*a* through an input terminal 712.

An optical film such as a polarizing plate, a circularly polarizing plate (including an elliptically polarizing plate), a retardation plate (a quarter-wave plate or a half-wave plate), or a color filter may be provided on a light-emitting surface as needed. Further, in addition to the polarizing plate or the circularly polarizing plate, an anti-reflection film may be provided in order to suppress external light reflection. Alternatively, projections and depressions are provided on the light-emitting surface and reflected light is diffused, whereby reflection of the external light on the light-emitting surface can be suppressed.

Although FIG. 9 illustrates the example in which a driver circuit is not provided over the substrate, an IC chip including a driver circuit may be mounted on the substrate.

When the IC chip is mounted, a data line side IC and a scan line side IC, in each of which the driver circuit for transmitting a signal to a pixel portion is formed, are mounted on the periphery of (outside) the pixel portion. As a method for mounting an IC chip, a COG method, TCP, a wire bonding method, or the like can be used. TCP is TAB tape on which an IC is mounted, and the IC is mounted by connecting the TAB tape to wirings over the element-forming substrate. The data line side IC and the scan line side IC may be formed using a silicon substrate or a silicon on insulator (SOI) substrate, or may be formed over a glass substrate, a quartz substrate, or a plastic substrate.

Figure 10A:
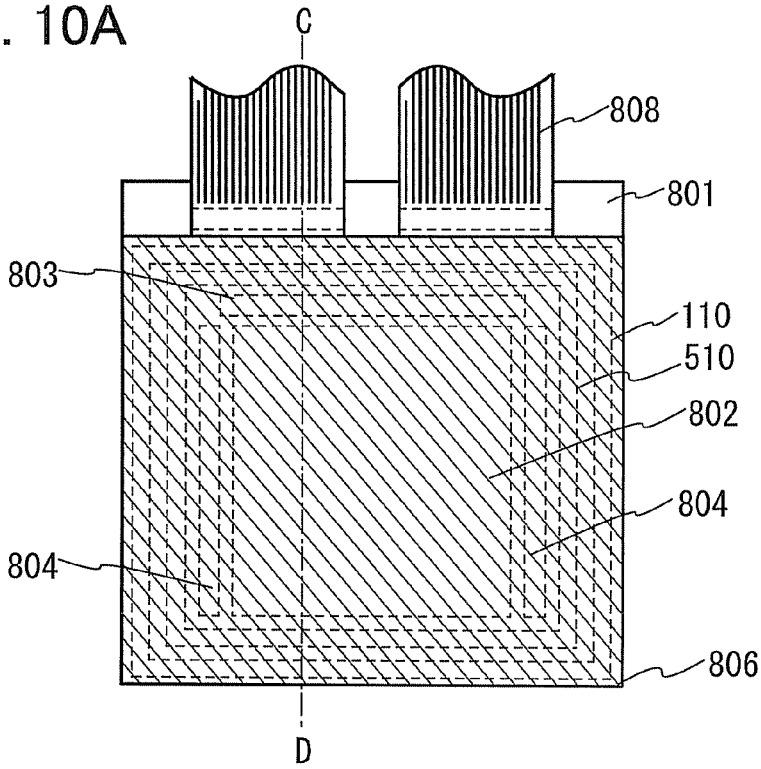
FIGS. 10A and 10B are views illustrating an example of an electroluminescent device according to one embodiment of the present invention.
Figure 10B:
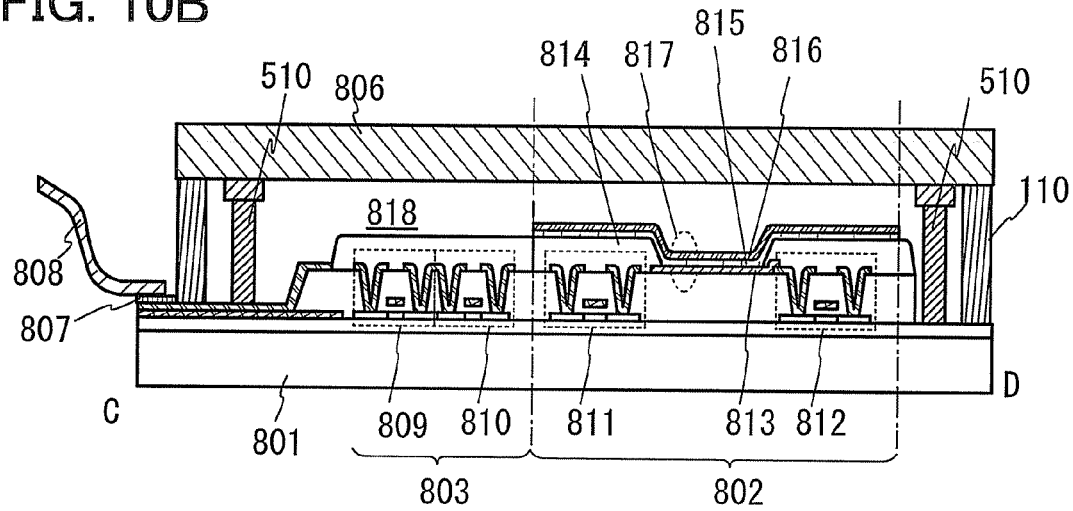

Next, an example of an active matrix EL device will be described with reference to FIGS. 10A and 10B. Note that FIG. 10A is a plan view illustrating the EL device, and FIG. 10B is a cross-sectional view taken along chain line C-D in FIG. 10A. The active matrix EL device of this embodiment includes a pixel portion 802 provided over a glass substrate 801, a driver circuit portion (a source-side driver circuit) 803, and a driver circuit portion (a gate-side driver circuit) 804. The pixel portion 802, the driver circuit portion 803, and the driver circuit portion 804 are provided in a sealed body 818 surrounded by the sealant 510 using the sheet in which different kinds of metals are stacked, the glass substrate 801, and the glass substrate 806 (sealing substrate).

Over the glass substrate 801, a lead wiring 807 for connecting an external input terminal through which a signal (e.g., a video signal, a clock signal, a start signal, a reset signal, or the like) or electric potential from the outside is transmitted to the driver circuit portion 803 and the driver circuit portion 804 is provided. Here, an example is described in which a FPC 808 is provided as the external input terminal. Note that although only an FPC is illustrated here, a printed wiring board (PWB) may be attached thereto. In this specification, the EL device includes in its category the EL device itself and the EL device on which the FPC or the PWB is mounted.

Next, a cross-sectional structure of the active matrix EL device is described with reference to FIG. 10B. Although the driver circuit portion 803, the driver circuit portion 804, and the pixel portion 802 are formed over the glass substrate 801, the pixel portion 802 and the driver circuit portion 803 which is the source-side driver circuit are illustrated in FIG. 10B.

In the driver circuit portion 803, an example including a CMOS circuit which is a combination of an n-channel TFT 809 and a p-channel TFT 810 is illustrated. Note that the driver circuit portion can be formed with various types of circuits such as CMOS circuits, PMOS circuits, or NMOS circuits. In this embodiment, a driver-integrated type in which a driver circuit and the pixel portion are formed over the same substrate is described; however, the present invention is not limited to this structure, and a driver circuit can be formed over a substrate that is different from the substrate over which a pixel portion is formed.

The pixel portion 802 has a plurality of pixels, each including a switching TFT 811, a current-controlling TFT 812, and an anode 813 electrically connected to a wiring (a source electrode or a drain electrode) of the current-controlling TFT 812. Note that there is no particular limitation on structures of the TFTs such as the switching TFT 811 and the current-controlling TFT 812. For example, a staggered TFT or an inverted-staggered TFT may be used. A top-gate TFT or a bottom-gate TFT may also be used. There is no particular limitation also on materials of a semiconductor used for the TFTs, and silicon or an oxide semiconductor such as oxide including indium, gallium, and zinc may be used. In addition, crystallinity of a semiconductor used for the TFT is not particularly limited either; an amorphous semiconductor or a crystalline semiconductor may be used.

A light-emitting element 817 includes an anode 813, an organic EL layer 815, and a cathode 816. The structure, the material, and the like of the light-emitting element are as described above. Note that the anode 813, the organic EL layer 815, and the cathode 816 in FIGS. 10A and 10B correspond to the first electrode 202, the organic EL layer 203, and the second electrode 204 in Embodiment 2, respectively. Although not illustrated, the cathode 816 is electrically connected to the FPC 808 which is an external input terminal.

The insulator 814 is provided so as to cover an end portion of the anode 813. Further, in order that the cathode 816 formed over the insulator 814 favorably covers the insulator 814, a corner portion of the insulator 814 is preferably rounded. For example, the corner portion of the insulator 814 is preferably formed as a curved surface having a curvature radius of 0.2 μm to 3 μm. The insulator 814 can be formed using an organic compound such as a negative photosensitive resin which becomes insoluble in an etchant by light irradiation or a positive photosensitive resin which becomes soluble in an etchant by light irradiation, or an inorganic compound such as silicon oxide or silicon oxynitride.

Although the cross-sectional view of FIG. 10B illustrates only one light-emitting element 817, a plurality of light-emitting elements are arranged in matrix in the pixel portion 802. For example, light-emitting elements that emit light of three kinds of colors (R, G, and B) are selectively formed in the pixel portion 802, so that an EL device capable of full color display can be obtained. Alternatively, an EL device capable of full color display may be obtained in such a way that the light-emitting element which emits white light described in the above embodiment is combined with a color filter. Further, the light-emitting element can have any of a bottom emission structure, a top emission structure, and a dual emission structure.

Further, the light-emitting element 817 is provided in the sealed body 818 surrounded by the glass substrate 801, the glass substrate 806, and the sealant 510 using the sheet in which different kinds of metals are stacked. The sealed body 818 may be filled with a rare gas, a nitrogen gas, or a solid.

As described above, the active matrix EL device in which sealing is performed by the method for forming the sealed body according to one embodiment of the present invention can be obtained. Such an EL device has high reliability.

The structures, methods, and the like described in this embodiment can be combined as appropriate with any of the structures, methods, and the like described in the other embodiments.

Embodiment 5

In this embodiment, an electronic device manufactured using the EL device manufactured by the manufacturing method described in the above embodiment, and an specific example in which the EL device is used as a lighting device, will be described with reference to FIGS. 11A to 11E and FIG. 12.

Examples of electronic devices to which the present invention can be applied include a television set (also referred to as a television or a television receiver), a monitor of a computer or the like, a digital camera, a digital video camera, a digital photo frame, a mobile phone, a portable game machine, a portable information terminal, an audio reproducing device, a game machine (e.g., a pachinko machine or a slot machine), a housing of a game machine, and the like. Some specific examples of these electronic devices and lighting devices are illustrated in FIGS. 11A to 11E and FIG. 12.

Figure 11A:
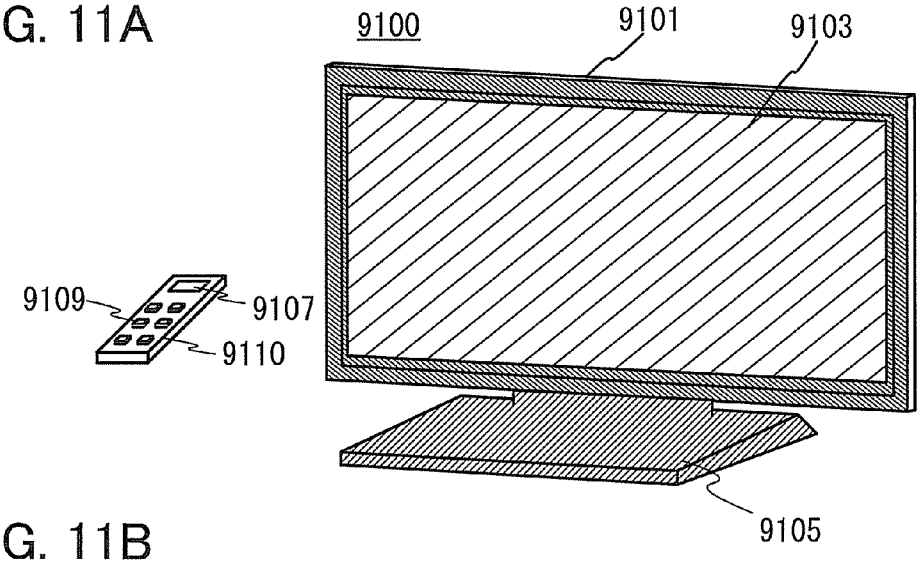
FIGS. 11A to 11E are views illustrating examples of electronic devices and a lighting device according to one embodiment of the present invention.

FIG. 11A illustrates a television set 9100. In the television set 9100, a display portion 9103 is incorporated in a housing 9101. An EL device manufactured using one embodiment of the present invention can be used in the display portion 9103, so that an image can be displayed on the display portion 9103. Note that the housing 9101 is supported by a stand 9105 here.

The television set 9100 can be operated with an operation switch of the housing 9101 or a separate remote controller 9110. Channels and volume can be controlled with an operation key 9109 of the remote controller 9110 so that an image displayed on the display portion 9103 can be controlled. Furthermore, the remote controller 9110 may be provided with a display portion 9107 for displaying data output from the remote controller 9110.

The television set 9100 illustrated in FIG. 11A is provided with a receiver, a modem, and the like. With the receiver, the television set 9100 can receive a general television broadcast. Further, when the television set 9100 is connected to a communication network by wired or wireless connection via the modem, one-way (from a transmitter to a receiver) or two-way (between a transmitter and a receiver or between receivers) data communication can be performed.

When the EL device in which the light-emitting element is sealed with the sealant 510 using the sheet in which different kinds of metals are stacked, which is described in the above embodiment, is used, the light-emitting element is unlikely to be deteriorated. Accordingly, when the EL device is used for the display, portion 9103 of the television set, the television set can have higher durability and a longer lifetime than before.

Figure 11B:
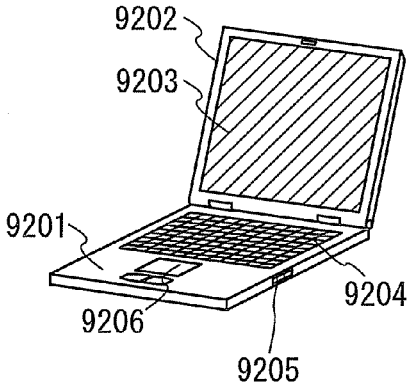

FIG. 11B illustrates a computer which includes a main body 9201, a housing 9202, a display portion 9203, a keyboard 9204, an external connection port 9205, a pointing device 9206, and the like. The computer is manufactured using an EL device manufactured using one embodiment of the present invention for the display portion 9203.

When the EL device in which the light-emitting element is sealed with the sealant 510 using the sheet in which different kinds of metals are stacked, which is described in the above embodiment, is used, the light-emitting element is unlikely to be deteriorated. Accordingly, when the EL device is used for the display portion 9203 of the computer, the display portion can have higher durability and a longer lifetime than before.

Figure 11C:
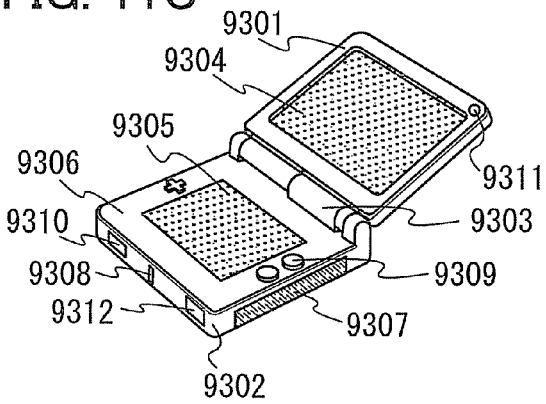

FIG. 11C illustrates a portable game machine including a housing 9301 and a housing 9302 which are jointed with a connector 9303 so as to be opened and closed. A display portion 9304 is incorporated in the housing 9301, and a display portion 9305 is incorporated in the housing 9302. In addition, the portable game machine illustrated in FIG. 11C includes an input means such as operation keys 9309, a connection terminal 9310, a sensor 9311 (a sensor having a function of measuring force, displacement, position, speed, acceleration, angular velocity, rotational frequency, distance, light, liquid, magnetism, temperature, chemical substance, sound, time, hardness, electric field, current, voltage, electric power, radiation, flow rate, humidity, gradient, oscillation, odor, or infrared rays), or a microphone 9312. The portable game machine may further be provided with a speaker portion 9306, a recording medium insertion portion 9307, an LED lamp 9308, and the like. Needless to say, the structure of the portable game machine is not limited to the above, and it is acceptable as long as the EL device manufactured using one embodiment of the present invention is used for one or both of the display portion 9304 and the display portion 9305.

The portable game machine illustrated in FIG. 11C has a function of reading a program or data stored in a recording medium to display it on the display portion, and a function of sharing information with another portable game machine by wireless communication. Note that a function of the portable game machine illustrated in FIG. 11C is not limited to the above, and the portable game machine can have a variety of functions.

When the EL device in which the light-emitting element is sealed with the sealant 510 using the sheet in which different kinds of metals are stacked, which is described in the above embodiment, is used, the light-emitting element is unlikely to be deteriorated. Accordingly, when the EL device is used for the display portions 9304 and 9305 of the portable game machine, the portable game machine can have higher durability and a longer lifetime than before.

Figure 11D:
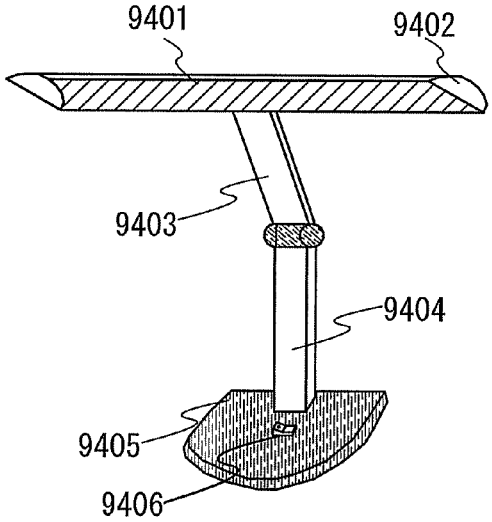
Figure 11E:
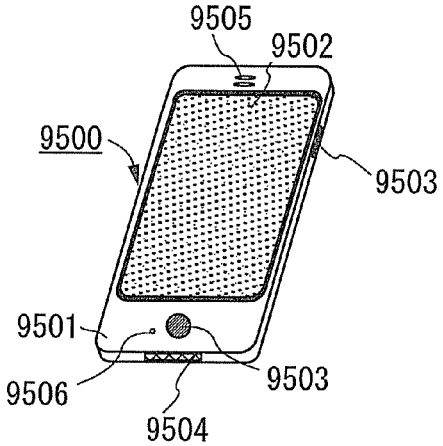

FIG. 11E illustrates an example of a mobile phone. A mobile phone 9500 is provided with a display portion 9502 incorporated in a housing 9501, an operation button 9503, an external connection port 9504, a speaker 9505, a microphone 9506, and the like. Note that the mobile phone 9500 is manufactured using an EL device manufactured using one embodiment of the present invention for the display portion 9502.

Users can input data, make a call, or text a message by touching the display portion 9502 of the mobile phone 9500 illustrated in FIG. 11E with their fingers or the like.

There are mainly three screen modes for the display portion 9502. The first mode is a display mode mainly for displaying images. The second mode is an input mode mainly for inputting data such as text. The third mode is a display-and-input mode in which two modes of the display mode and the input mode are combined.

For example, in the case of making a call or text messaging, a text input mode mainly for inputting text is selected for the display portion 9502 so that characters displayed on a screen can be input. In this case, a keyboard or number buttons are preferably displayed on almost the entire screen of the display portion 9502.

By providing a detection device which includes a sensor for detecting inclination, such as a gyroscope or an acceleration sensor, inside the mobile phone 9500, the direction of the mobile phone 9500 (whether the mobile phone 9500 is placed horizontally or vertically for a landscape mode or a portrait mode) is determined so that display on the screen of the display portion 9502 can be automatically switched.

In addition, the screen mode is switched by touching the display portion 9502 or operating the operation button 9503 of the housing 9501. Alternatively, the screen modes can be switched depending on kinds of images displayed in the display portion 9502. For example, when a signal of an image displayed on the display portion is a signal of moving image data, the screen mode is switched to the display mode. When the signal is a signal of text data, the screen mode is switched to the input mode.

Moreover, in the input mode, when input by touching the display portion 9502 is not performed within a specified period of time while a signal detected by an optical sensor in the display portion 9502 is detected, the screen mode may be controlled so as to be switched from the input mode to the display mode.

The display portion 9502 can also function as an image sensor. For example, an image of a palm print, a fingerprint, or the like is taken by touching the display portion 9502 with the palm or the finger, whereby personal authentication can be performed. Further, by providing a backlight or a sensing light source which emits a near-infrared light in the display portion, an image of a finger vein, a palm vein, or the like can be taken.

When the EL device in which the light-emitting element is sealed with the sealant 510 using the sheet in which different kinds of metals are stacked, which is described in the above embodiment, is used, the light-emitting element is unlikely to be deteriorated. Accordingly, when the EL device is used for the display portion 9502 of the mobile phone, the mobile phone can have higher durability and a longer lifetime than before.

FIG. 11D illustrates a tabletop lighting device including a lighting portion 9401, a shade 9402, an adjustable arm 9403, a support 9404, a base 9405, and a power supply switch 9406. The tabletop lighting device is manufactured using an EL device manufactured using one embodiment of the present invention for the lighting portion 9401. Note that the modes of the lighting device is not limited to tabletop lighting devices, but include ceiling-fixed lighting devices, wall-hanging lighting devices, portable lighting devices, and the like.

Figure 12:
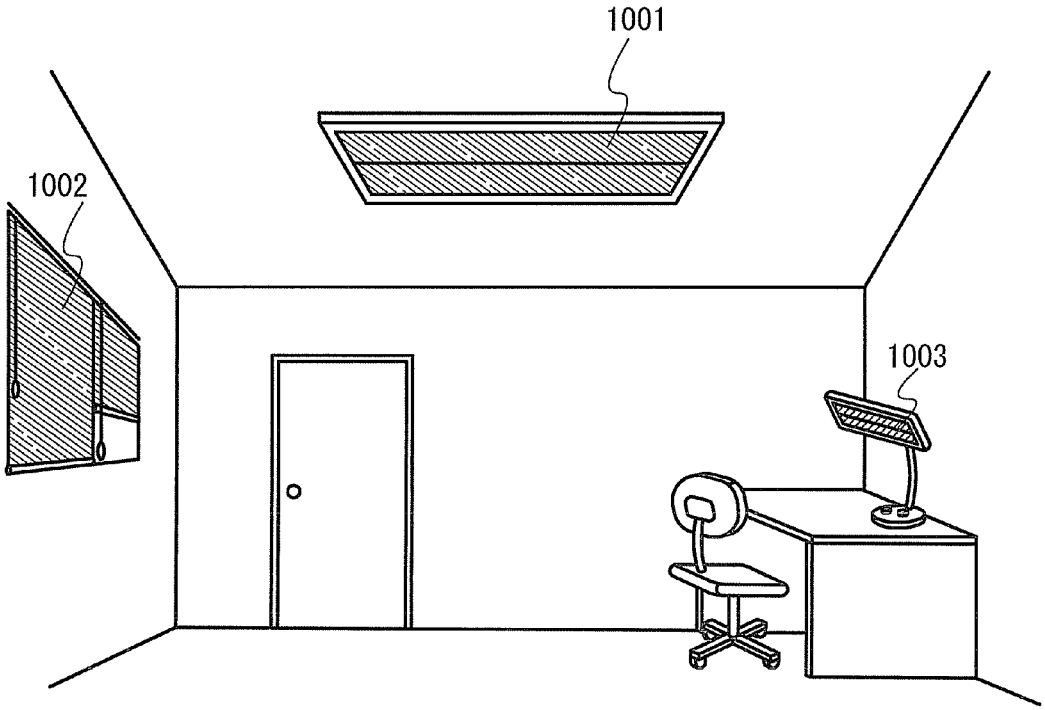
FIG. 12 is a view illustrating examples of lighting devices according to one embodiment of the present invention.

FIG. 12 illustrates an example in which the EL device manufactured using one embodiment of the present invention is used for an indoor lighting device 1001. Since the EL device manufactured using one embodiment of the present invention can have a large area, the EL device can be used as a lighting device having a large area. In addition, the EL device described in the above embodiments can be made thin and thus can be used as a roll-up type lighting device 1002. In order to manufacture such a device, for example, an extremely thin glass substrate capable of being wound may be used as part of a glass sealed body. Although the glass substrate is extremely thin enough to be wounded, it is extremely unlikely to transmit moisture or oxygen; therefore, it is preferably applied to the present invention. As illustrated in FIG. 12, a tabletop lighting device 1003 as explained in FIG. 11D may be used in a room provided with the indoor lighting device 1001.

When the EL device in which the light-emitting element is sealed with the sealant 510 using the sheet in which different kinds of metals are stacked, which is described in the above embodiment, is used, the light-emitting element is unlikely to be deteriorated. Accordingly, when the EL device is used for the lighting device, the lighting device can have higher durability and a longer lifetime than before.

Figure 13:
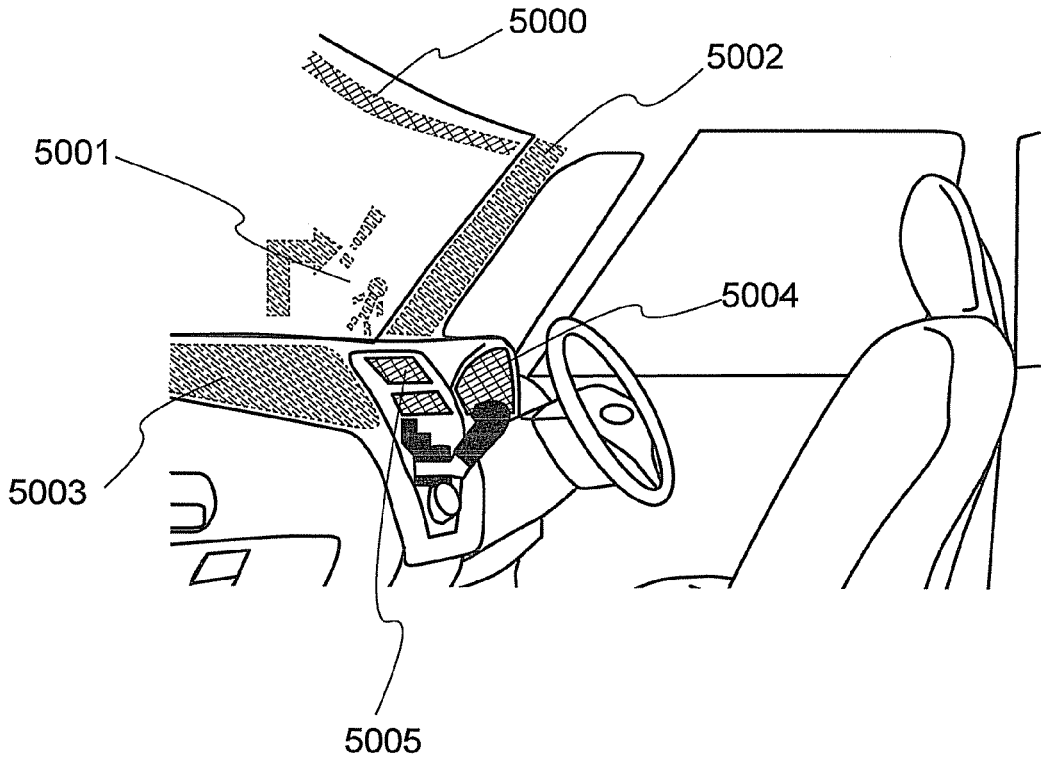
FIG. 13 is a view illustrating an example of a vehicle-mounted display device according to one embodiment of the present invention.

FIG. 13 illustrates a mode in which the EL device in which sealing is performed by the method for forming the sealed body according to one embodiment of the present invention is used for an automobile windshield or dashboard.

The EL devices in each of which sealing is performed with the sealant 510 using the sheet in which different kinds of metals are stacked according to one embodiment of the present invention, and which are provided for the automobile windshield are illustrated as a display device 5000 and a display device 5001. The light-emitting element described in Embodiment 2 or 3 can be formed into so-called see-through display device, through which the opposite side can be seen, by including a first electrode and a second electrode which have a light-transmitting property. Such a see-through display device can be provided even in the windshield on the car, without hindering the vision. In addition, for example, when a transistor for driving the light-emitting element is provided, a transistor having a light-transmitting property, such as an organic transistor using an organic semiconductor material or a transistor using an oxide semiconductor, is preferably used.

The light-emitting element described in Embodiment 2 or 3, which is provided in a pillar portion, is illustrated in a display device 5002. The display device 5002 can compensate for the view hindered by the pillar portion by showing an image taken by an imaging unit provided in the car body. Similarly, the display device 5003 provided in the dashboard can compensate for the view hindered by the car body by showing an image taken by an imaging unit provided in the outside of the car body, which leads to elimination of blind areas and enhancement of safety. Showing an image so as to compensate for the area which a driver cannot see, makes it possible for the driver to confirm safety easily and comfortably.

The display device 5004 and the display device 5005 can provide a variety of kinds of information such as information of navigation, speedometer, tachometer, mileage, fuel meter, gearshift indicator, and air condition. The content or layout of the display can be changed freely by a user as appropriate. Further, such information can also be shown in the display devices 5000 to 5003. Note that the display devices 5000 to 5005 can also be used as lighting devices.

Since the EL device in which sealing is performed by the method for forming the sealed body according to one embodiment of the present invention is highly reliable, the EL device can be preferably used as an in-car EL device.

The structures, methods, and the like described in this embodiment can be combined as appropriate with any of the structures, methods, and the like described in the other embodiments.

This application is based on Japanese Patent Application serial no. 2011-089601 filed with Japan Patent Office on Apr. 13, 2011, the entire contents of which are hereby incorporated by reference.

What is claimed is:

1. A method for manufacturing a light-emitting device comprising the steps of:

providing a stack on a periphery of a first substrate, the stack including a first layer and a second layer, the first layer comprising a first material, and the second layer comprising a second material different from the first material;

providing a second substrate over the first substrate with the stack interposed between the first substrate and the second substrate; and melting the first layer and the second layer by a heat treatment to heat the stack, and bonding the first substrate and the second substrate to each other through the melted first layer and second layer, wherein a light-emitting element is provided on the first substrate or the second substrate, wherein the first material is one selected from the group consisting of aluminum, nickel, titanium, silicon and carbon, and wherein the second material is one selected from the group consisting of aluminum, nickel, titanium, silicon and carbon.

2. The method according to claim 1, wherein the heat treatment is a light irradiation to only a portion of the stack.

3. The method according to claim 2, wherein the light is a laser beam.

4. The method according to claim 1, wherein a solder layer is provided on a periphery of the second substrate so as to overlap and be in contact with the stack by providing the second substrate over the first substrate with the stack and the solder layer interposed between the first substrate and the second substrate, and wherein the solder layer is melted by the heat treatment.

5. A method for manufacturing a light-emitting device comprising the steps of:

providing a second substrate over a first substrate with a stack interposed between the first substrate and the second substrate, wherein the stack includes a first layer and a second layer, the first layer comprising a first material, and the second layer comprising a second material different from the first material; and melting the first layer and the second layer by a heat treatment to heat the stack, and bonding the first substrate and the second substrate to each other through the melted first layer and second layer, wherein a light-emitting element is provided on the first substrate or the second substrate, wherein the first material is one selected from the group consisting of aluminum, nickel, titanium, silicon and carbon, and wherein the second material is one selected from the group consisting of aluminum, nickel, titanium, silicon and carbon.

6. The method according to claim 5, wherein the heat treatment is a light irradiation to only a portion of the stack.

7. The method according to claim 6, wherein the light is a laser beam.

8. The method according to claim 5, wherein a first solder layer is provided on the first substrate, and a second solder layer is provided on the second substrate, so as to overlap and be in contact with the stack by providing the second substrate over the first substrate with the stack, the first solder layer and the second solder layer interposed between the first substrate and the second substrate, and wherein the first solder layer and the second solder layer are melted by the heat treatment.

9. The method according to claim 5, wherein a third layer containing a glass is provided on the first substrate, and a fourth layer containing a glass is provided on the second substrate, so as to overlap and be in contact with the stack by providing the second substrate over the first substrate with the stack, the third layer and the fourth layer interposed between the first substrate and the second substrate, and wherein the third layer and the fourth layer are melted by the heat treatment.

10. The method according to claim 9, wherein the third layer containing a glass is a first frit glass paste, and the fourth layer containing a glass is a second fit glass paste.

11. The method according to claim 9, wherein the third layer containing a glass is a first glass ribbon, and the fourth layer containing a glass is a second glass ribbon.

12. The method according to claim 5, wherein a third layer containing a glass is provided on a first surface of the stack, and a fourth layer containing a glass is provided on a second surface of the stack, which is opposite to the first surface, and wherein the third layer and the fourth layer are melted by the heat treatment.

13. The method according to claim 12, wherein the third layer containing a glass is a first glass ribbon, and the fourth layer containing a glass is a second glass ribbon.

* * * * *

UNITED STATES PATENT AND TRADEMARK OFFICE

CERTIFICATE OF CORRECTION

PATENT NO. : 8,545,281 B2
APPLICATION NO. : 13/445113
DATED : October 1, 2013
INVENTOR(S) : Akihisa Shimomura and Kaoru Hatano It is certified that error appears in the above-identified patent and that said Letters Patent is hereby corrected as shown below:

Title page, item (54) and in the Specification, Column 1, Title; Change "ELECTROLUMINESCCENT" to --ELECTROLUMINESCENT--.

In the Specification:

Column 1, line 17; Change "fanned" to --formed--.
Column 3, line 1; Change "crack for due" to --crack formed due--.
Column 3, line 29; Change "fainted" to --formed--.
Column 11, line 9; Change "(4-tent-butylphenyl)" to --(4-tert--butylphenyl)--.
Column 12, line 38; Change "niobium oxide;" to --niobium oxide,--.
Column 17, line 23; Change "display, portion" to --display portion--.

In the Claims:

Column 22, line 13, Claim 10; Change "second fit glass" to --second frit glass--.

Signed and Sealed this
Seventh Day of January, 2014

Margaret A. Focarino

Margaret A. Focarino
*Commissioner for Patents of the United States Patent and Trademark Office*